US009142077B2

(12) United States Patent
Sakoguchi et al.

(10) Patent No.: US 9,142,077 B2
(45) Date of Patent: Sep. 22, 2015

(54) SHEET PROCESSING APPARATUS AND SHEET PROCESSING METHOD

(75) Inventors: Yoshitaka Sakoguchi, Yokohama (JP); Kazuhiro Mukai, Yokohama (JP); Hisashi Oosawa, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 526 days.

(21) Appl. No.: 13/529,837

(22) Filed: Jun. 21, 2012

(65) Prior Publication Data

US 2012/0279173 A1 Nov. 8, 2012

Related U.S. Application Data

(63) Continuation of application No. PCT/JP2010/073023, filed on Dec. 21, 2010.

(30) Foreign Application Priority Data

Dec. 21, 2009 (JP) ..... 2009-289637

(51) Int. Cl.
*G07D 11/00* (2006.01)
*B65B 13/02* (2006.01)

(52) U.S. Cl.
CPC ..... *G07D 11/0081* (2013.01); *G07D 11/0024* (2013.01)

(58) Field of Classification Search
CPC ..... G07D 11/0024; G07D 11/0081
USPC ..... 100/8, 26, 7, 33 PB; 271/162, 165, 166, 271/298, 265.01, 3.08, 23, 35, 131–135; 53/171, 540, 582; 209/534; 902/15, 16; 194/206, 207
See application file for complete search history.

(56) References Cited

U.S. PATENT DOCUMENTS 4,473,005 A * 9/1984 Pasic ..... 100/7
4,554,867 A * 11/1985 Thumm ..... 100/3
4,697,071 A 9/1987 Hiraoka et al.
4,883,183 A 11/1989 Kimura et al.

(Continued)

FOREIGN PATENT DOCUMENTS

CN 1267044 9/2000
CN 1589979 3/2005

(Continued)

OTHER PUBLICATIONS

International Search Report for PCT/JP2010/073023.

(Continued)

*Primary Examiner* — Jimmy T Nguyen
(74) *Attorney, Agent, or Firm* — Oblon, McClelland, Maier & Neustadt, L.L.P.

(57) ABSTRACT

According to one embodiment, a sheet processing apparatus includes a feeding unit including a support surface inclined with respect to a vertical direction and a stacking surface substantially perpendicular to the support surface, a plurality of paper sheets being stacked on the stacking surface in such a manner that the paper sheets are inclined along the support surface, a pick up mechanism configured to pick up the paper sheets from a side of the stacking surface of the feeding unit, a conveying path configured to convey the picked up paper sheets, an inspection device configured to inspect the conveyed paper sheet, and an accumulation unit configured to accumulate the inspected paper sheets.

13 Claims, 16 Drawing Sheets

(56) References Cited

U.S. PATENT DOCUMENTS

| | | | | |
|---|---|---|---|---|
| 5,012,932 | A | 5/1991 | Omura et al. | |
| 5,430,664 | A | 7/1995 | Cargill et al. | |
| 6,170,822 | B1 * | 1/2001 | Kato et al. | 271/298 |
| 6,260,840 | B1 | 7/2001 | Suga et al. | |
| 6,328,166 | B1 | 12/2001 | Sakai | |
| 6,550,221 | B1 | 4/2003 | Neri | |
| 8,256,604 | B2 | 9/2012 | Ohishi | |
| 8,903,544 | B2 | 12/2014 | Uezono et al. | |
| 8,925,448 | B2 | 1/2015 | Sakoguchi et al. | |
| 2007/0063429 | A1 | 3/2007 | Kang | |
| 2009/0087076 | A1 | 4/2009 | Jenrick et al. | |
| 2010/0117294 | A1 | 5/2010 | Maekawa et al. | |
| 2014/0291110 | A1 | 10/2014 | Adachi et al. | |

FOREIGN PATENT DOCUMENTS

| | | | |
|---|---|---|---|
| CN | 1590259 | | 3/2005 |
| CN | 1600644 | | 3/2005 |
| CN | 101289120 | | 10/2008 |
| CN | 101559843 | | 10/2009 |
| EP | 1 516 818 | | 3/2005 |
| JP | 56-164489 | A | 12/1981 |
| JP | 60-674 | U | 1/1985 |
| JP | 60-026534 | | 2/1985 |
| JP | 62-019328 | | 1/1987 |
| JP | 62-78040 | A | 4/1987 |
| JP | 63-176239 | | 7/1988 |
| JP | 4-77 | U | 1/1992 |
| JP | 04-137093 | | 5/1992 |
| JP | 04-313533 | | 11/1992 |
| JP | 08-217269 | | 8/1996 |
| JP | 09-204550 | | 8/1997 |
| JP | 2000-143001 | | 5/2000 |
| JP | 2001-067526 | A | 3/2001 |
| JP | 2003-272027 | | 9/2003 |
| JP | 2004-280226 | A | 10/2004 |
| JP | 2005-059969 | | 3/2005 |
| JP | 2006-268605 | A | 10/2006 |
| JP | 2008-210258 | A | 9/2008 |
| JP | 2009-16698 | A | 7/2009 |
| JP | 2009-295132 | | 12/2009 |
| KR | 10-0175962 | | 4/1999 |
| KR | 10-0636046 | | 10/2006 |
| KR | 10-2009-063124 | | 6/2009 |
| WO | WO 2009/090975 | | 7/2009 |

OTHER PUBLICATIONS

Chinese Office Action dated Dec. 4, 2013 for Appln. No. 201080048580.0.

Korean Office Action dated Dec. 19, 2013 for Appln. No. 10-2013-7027516.

Korean Office Action dated Feb. 6, 2014 for Appln. No. 10-2012-7010760.

International Preliminary Report dated Jul. 19, 2012 on Patentability for PCT/JP2010/073023.

Office Action dated Jul. 19, 2013, issued in corresponding Korean Patent Application No. 10-2012-7010760.

Korean Office Action dated Sep. 19, 2013.

European Search Report dated May 7, 2013.

Office Action issued on Jan. 6, 2015 in the corresponding Japanese Patent Application No. 2014-026291 (with English Translation).

U.S. Office Action mailed Jan. 9, 2015, in corresponding U.S. Appl. No. 14/023,894.

U.S. Office Action mailed Jun. 10, 2014, in corresponding U.S. Appl. No. 14/023,894.

U.S. Office Action mailed Feb. 25, 2013, in corresponding U.S. Appl. No. 13/233,689.

U.S. Office Action mailed Aug. 17, 2012, in corresponding U.S. Appl. No. 13/233,689.

* cited by examiner

SHEET PROCESSING APPARATUS AND SHEET PROCESSING METHOD

CROSS REFERENCE TO RELATED APPLICATIONS

This application is a Continuation Application of PCT Application No. PCT/JP2010/073023, filed Dec. 21, 2010 and based upon and claiming the benefit of priority from prior Japanese Patent Application No. 2009-289637, filed Dec. 21, 2009, the entire contents of all of which are incorporated herein by reference.

FIELD

Embodiments described herein relate generally to a sheet processing apparatus and a sheet processing method for processing paper sheets such as bills (banknotes) and securities.

BACKGROUND

In recent years, in banks, large scale retail stores, and the like, many bills are handled every day, and there is a work for classifying and arranging these bills according to the nominal values and according to whether they are usable or damaged (i.e., according to the degree of damage and wear-out). When there are many bills, they are usually managed in such a manner that every 100 bills are strapped together. Therefore, a sheet arranging apparatus has been suggested as an apparatus for automating this kind of work for arranging bills. The bill processing apparatus includes a hopper unit for stacking and accommodating unclassified bills, a conveying mechanism for feeding and conveying the bills one by one therefrom, an inspection unit for distinguishing the type of a conveyed bill and the degree of damage of a conveyed bill, a plurality of pocket units for classifying and accumulating the distinguished bill on the basis of, e.g., nominal value, and a strapping unit for strapping every 100 bills accumulated, and the like.

For example, in finance institutions and the like, automatic teller machines (hereinafter referred to as ATMs) are widely available. The ATM automatically allows a client to, e.g., withdraw and transfer a transaction medium such as bills and coins. The number of ATMs installed are on the increase. The ATM includes an ATM cassette for accommodating bills serving as transaction media and a loading container such as a loading cassette. Bills are withdrawn from this loading container to a client. Alternatively, bills deposited by a client are accumulated in the loading container. In the ATM, it is necessary to refill and collect bills according to the situation of use. In this circumstance, a cash processing system has been suggested. The suggested cash processing system includes a loading container having a function of automatically refilling and collecting bills to/from a plurality of ATMs.

In the above cash processing system, it is necessary to separately prepare a loading container dedicated for refilling and recovering bills, which increases the cost. Moreover, each ATM needs to have a space for attaching the loading container, which increases the size of the ATM.

On the other hand, an apparatus for vertically stacking about 1000 sheets or less on a hopper unit at a time and performing pick up processing has been suggested. However, when more than 1000 sheets are stacked, the frictional force between the sheets increases due to the gravity of the stacked sheets. Therefore, when the sheets are picked up from the hopper unit, a separation force used in the frictional pick up process may be less than the frictional force between the sheets. As a result, the sheets may not be picked up in a stable manner, and this may cause problems of sheets such as slipping, two-sheets feeding, and multi-layered picking-up. In some cases, not only picked up sheets but also coins and foreign matters may be conveyed together. When they are conveyed to the inspection unit, the inspection unit may be damaged.

DETAILED DESCRIPTION

In general, according to one embodiment, a sheet processing apparatus comprises a feeding unit having a support surface inclined with respect to a vertical direction and a stacking surface substantially perpendicular to the support surface, a plurality of paper sheets being stacked on the stacking surface in such a manner that the paper sheets are inclined along the support surface; a pick up mechanism configured to pick up the paper sheets from a side of the stacking surface of the feeding unit; a conveying path configured to convey the picked up paper sheets; an inspection device configured to inspect the conveyed paper sheet; and an accumulation unit configured to accumulate the inspected paper sheets.

According to an embodiment, a sheet processing apparatus comprises a main module comprising: a feeding unit configured to stack a plurality of paper sheets in an overlapping manner; a pick up mechanism configured to pick up the paper sheets from the feeding unit; a conveying path configured to convey the picked up paper sheets; an inspection device configured to inspect the conveyed paper sheet; and an accumulation unit configured to accumulate the inspected paper sheets; and a loading module connected to the main module, the loading module comprising: an attaching unit to which a loading container of an automatic teller machine is attachable; a conveying path in communication with the main module to convey the paper sheets; a loading/pick up mechanism configured to load and pick up the paper sheet to/from the loading container; an inspection device configured to inspect the paper sheets picked up from the loading container; and a rejection container configured to accumulate a rejected paper sheet thus inspected; the loading module being configured to load the paper sheets conveyed from the main module to the loading container.

According to an embodiment, a sheet processing method comprises: attaching a loading container detached from an automatic teller machine to an attaching unit; picking up paper sheets from the loading container to inspect the paper sheets, and rejecting a rejected paper sheet; returning the inspected paper sheets back to the loading container, thus inspecting the paper sheets in the loading container; and inspecting paper sheets picked up from a feeding unit and loading the paper sheets to the loading container, in accordance with the inspection result.

Figure 1:
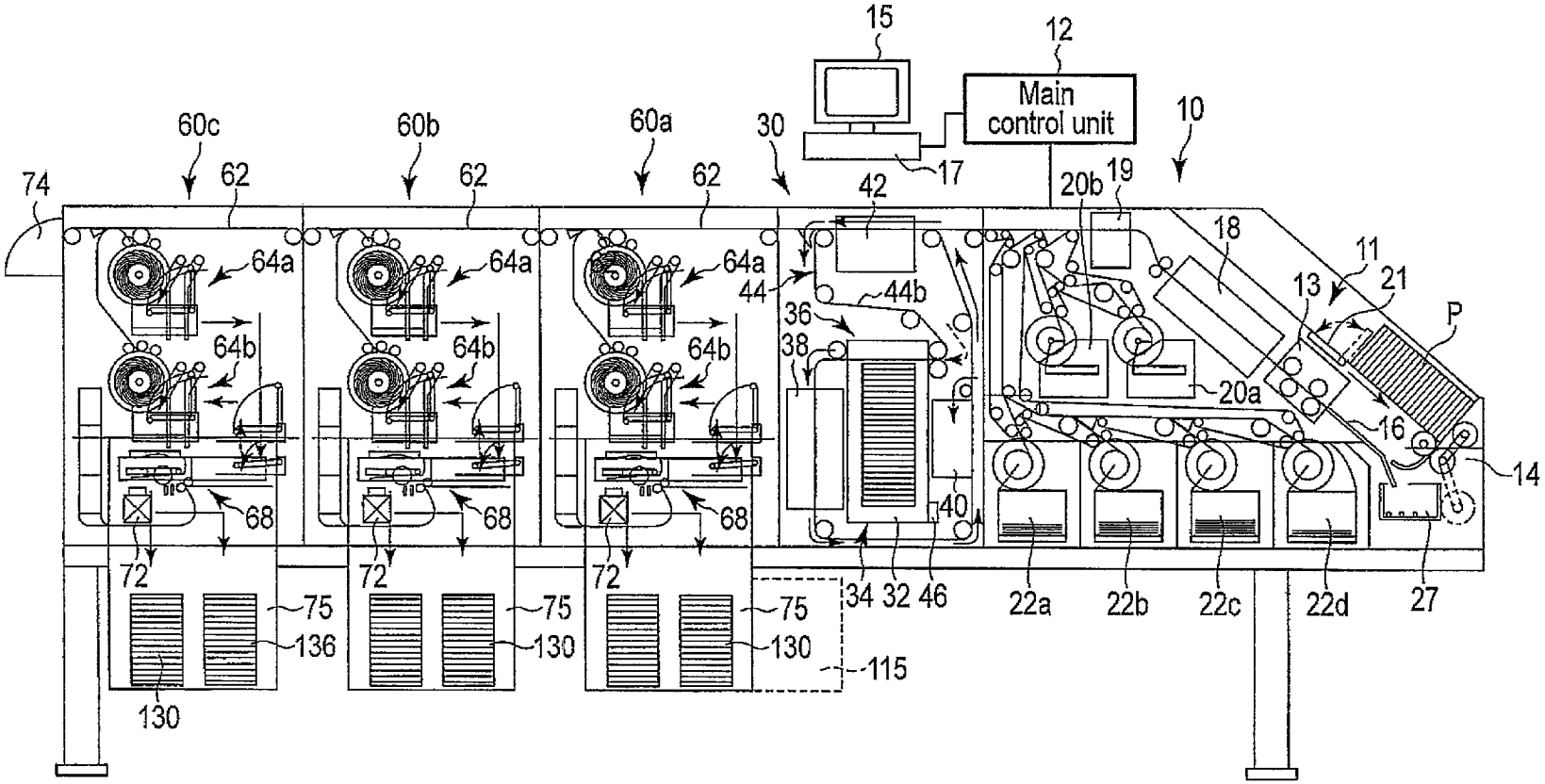
FIG. 1 is a cross sectional view illustrating a bill processing apparatus according to a first embodiment.
Figure 2:
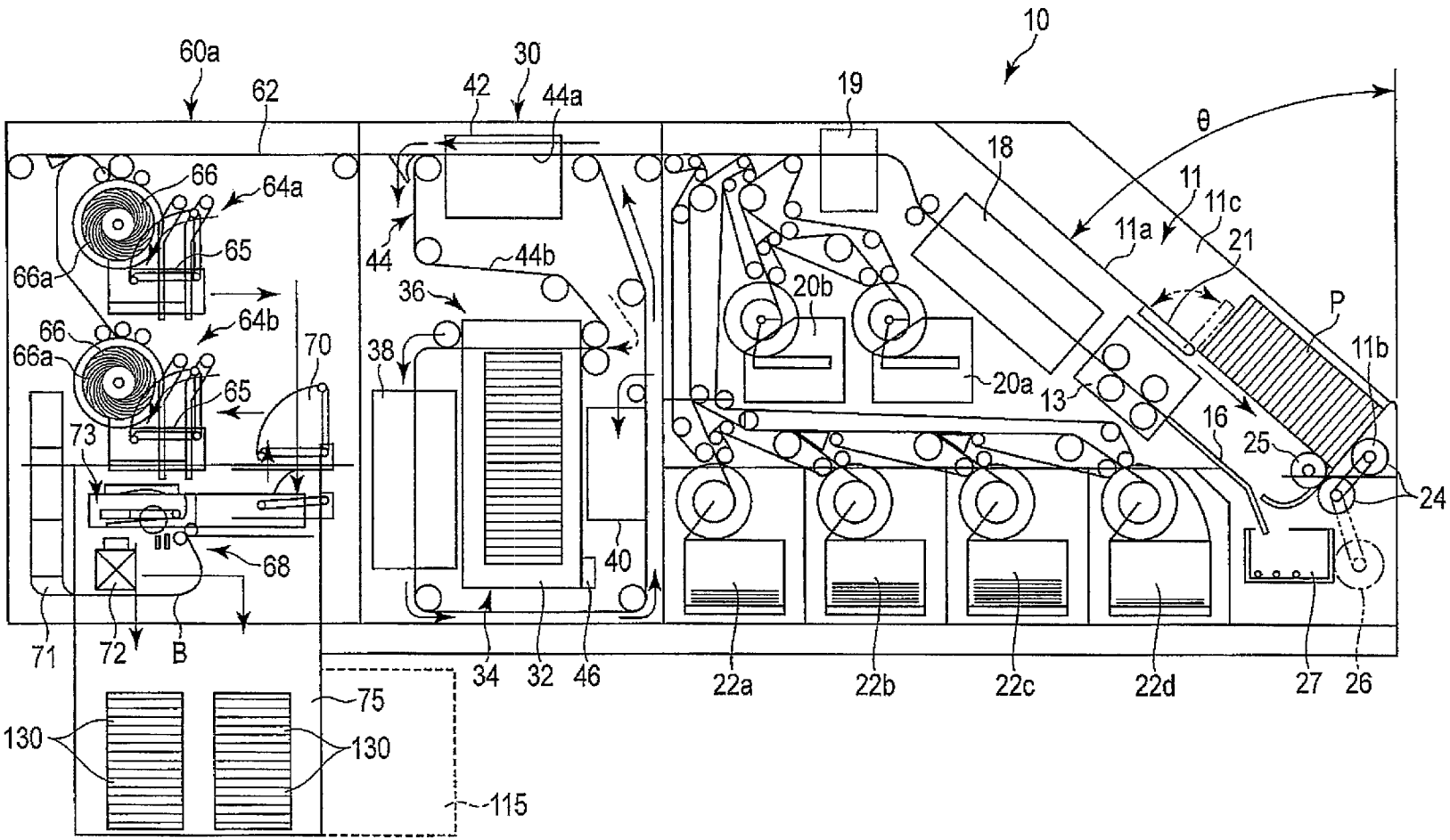
FIG. 2 is an enlarged cross sectional view illustrating a main module, a loading module, and a strapping module of the bill processing apparatus.

FIG. 1 is a cross sectional view schematically illustrating an overall configuration of a bill processing, apparatus according to a first embodiment. FIG. 2 is an enlarged cross sectional view illustrating a main module, a loading module, and a strapping module of the bill processing apparatus.

As shown in FIG. 1, the bill processing apparatus for processing bills serving as sheets includes a main module 10, a loading module 30, and three strapping modules 60*a*, 60*b*, and 60*c*. These modules are arranged in a line in this order, and are connected to each other both electrically and mechanically. The main module 10 includes a main control unit 12 for controlling overall operation of the main module and the entire apparatus.

Figure 3:
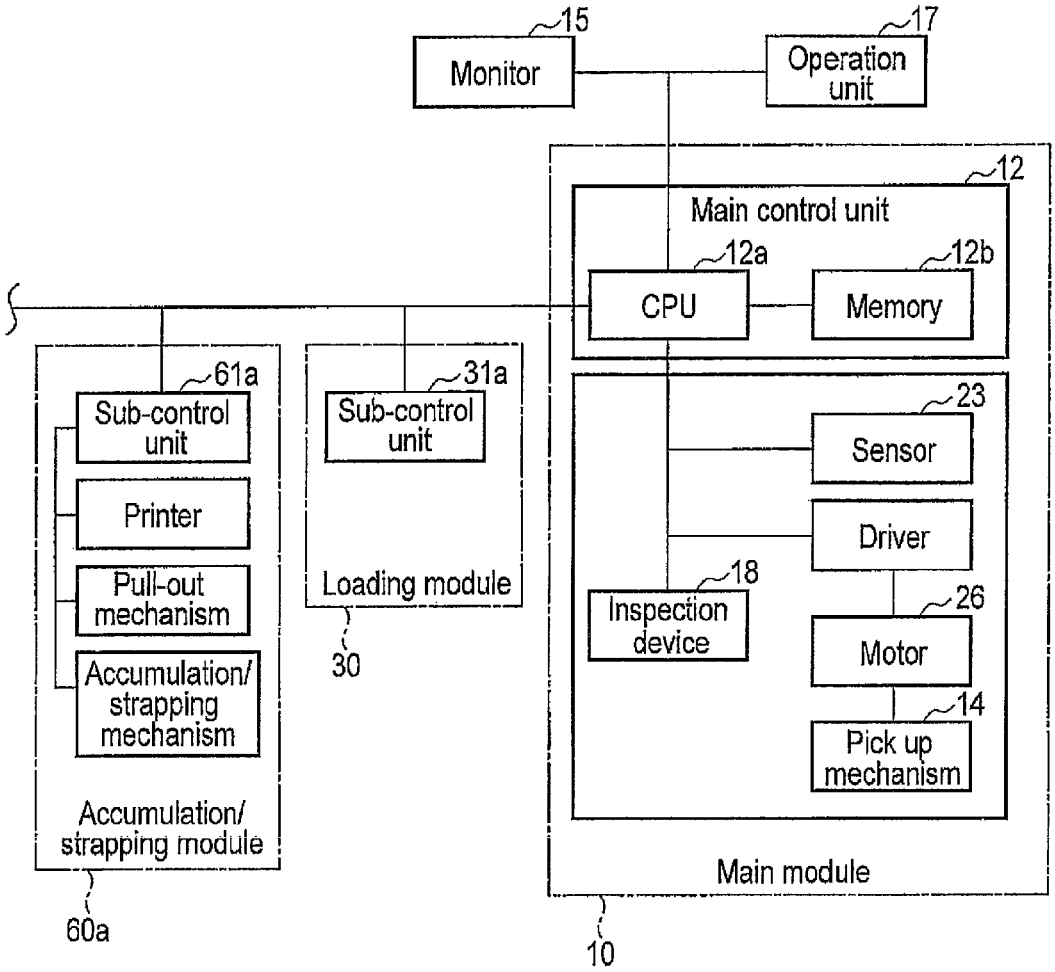
FIG. 3 is a block diagram schematically illustrating the bill processing apparatus.

As shown in FIGS. 1 and 3, the main control unit 12 is provided on a control board in the main module 10. The main control unit 12 includes a CPU 12*a* for controlling operation of each module and calculating operational state and efficiencies, various kinds of data, control programs, and a memory 12*b* for storing management information and the like. The memory 12*b* stores various kinds of data such as an operator ID, a date/time, a serial number, assign information, a bank logo, an administrator's signature image, print information that can be printed on a wrapping strap such as fonts in various languages, and processing speed of multiple stages of sheets, which are explained later.

The main control unit 12 is connected to an operation unit 17 for inputting various kinds of information to the apparatus and a monitor 15 serving as a display device for displaying input information, and an operational state and a processing state of the apparatus, and the like. The loading module 30 and the three strapping modules 60*a*, 60*b*, and 60*c* include sub-control units 31*a* and 61*a* for controlling operations of the respective modules. These sub-control units are connected to the main control unit 12 of the main module 10 via a LAN using an interface and a cable, not shown. The main control unit 12 is connected to a host computer, not shown. The main control unit 12 transmits and receives information exchanged between the main control unit 12 and the host computer, and manages the information.

An operator operates the operation unit 17 connected to the main control unit 12 to set various kinds of operational settings of the processing apparatus, such as setting of a transaction method such as depositing work and arranging work, loading processing to the loading container, inspection processing of bills in the loading container, setting of an accumulation container accommodating processed bills P, setting of strapping processing, and setting of damage level, i.e., a level used to determine a bill.

In addition, the main control unit 12 calculates management information including a processing efficiency in a unit time, a processing efficiency of each of a plurality of days, a processing efficiency for each operator ID, the total number of processed sheets, a total operation time, in accordance with processing information provided from an inspection device 18 explained later, and stores the management information to the memory 12*b* and displays the management information on the monitor 15.

As shown in FIGS. 1 and 2, the main module 10 comprises a feeding unit 11 on which many bills P are placed in a stacked state, a pick up mechanism 14 for picking up bills P from the feeding unit 11 one by one, and a conveying path 16 through which the bills P picked up by the pick up mechanism 14 are conveyed. A plurality of pairs of endless conveying belts, not shown, are provided to extend along the conveying path 16 so as to sandwich the conveying path 16. The picked up bills P are conveyed while being sandwiched between the conveying belts.

Figure 4:
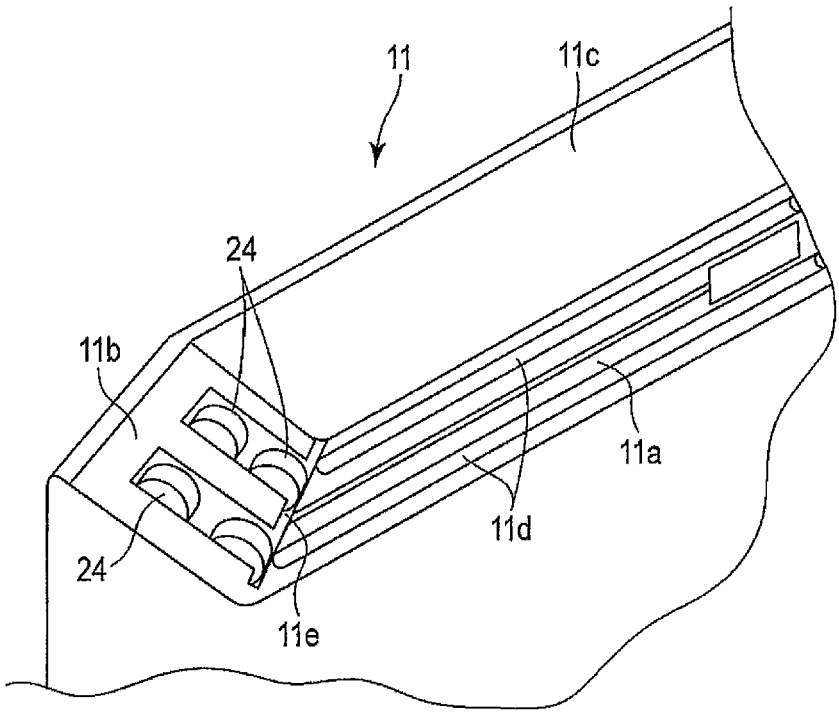
FIG. 4 is a perspective view illustrating a feeding unit of the bill processing apparatus.
Figure 5:
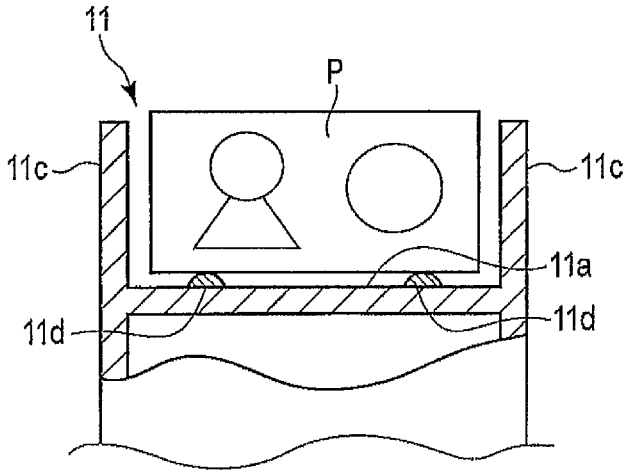
FIG. 5 is a cross sectional view illustrating the feeding unit.

As shown in FIGS. 2, 4, and 5, the feeding unit 11 includes a support surface 11*a* extending in a direction inclined by an angle θ with respect to a vertical direction, a stacking surface 11*b* extending in a direction substantially perpendicular to the support surface 11*a* from a lower end of the support surface 11*a*, and a pair of guide walls 11*c* arranged vertically along both side ends of the stacking surface 11*b* and the support surface 11*a*. At a border portion between the support surface 11*a* and the stacking surface 11*b*, a pick up opening 11*e* is formed to pick up the bills P into the apparatus. This feeding unit 11 is arranged in the main module 10 at one end of the main body of the apparatus. Further, a lower portion of the feeding unit 11, i.e., the stacking surface 11*b*, is located in proximity to a lower end of the main body of the apparatus.

The feeding unit 11 can hold a plurality of bills P, e.g., 2000 or more bills P, in a stacked state. The stacked bills P are placed on the feeding unit 11 in an inclined manner along the support surface so that the lowermost bill is placed on the stacking surface 11*b* and, e.g., edges of longer sides of the bills are placed on the support surface 11*a*. The stacked bills P are picked up, one by one, into the apparatus via the pick up opening lie by the pick up mechanism 14. At this occasion, the lowermost bill P is successively picked up first.

The inclination angle θ of the support surface 11*a* is set in a range between 25 to 75 degrees. More specifically, it is set in a range between 30 to 40 degrees. The support surface 11*a* is made to be rotatable with respect to the main body of the apparatus. The inclination angle θ may be adjustable.

Figure 6:
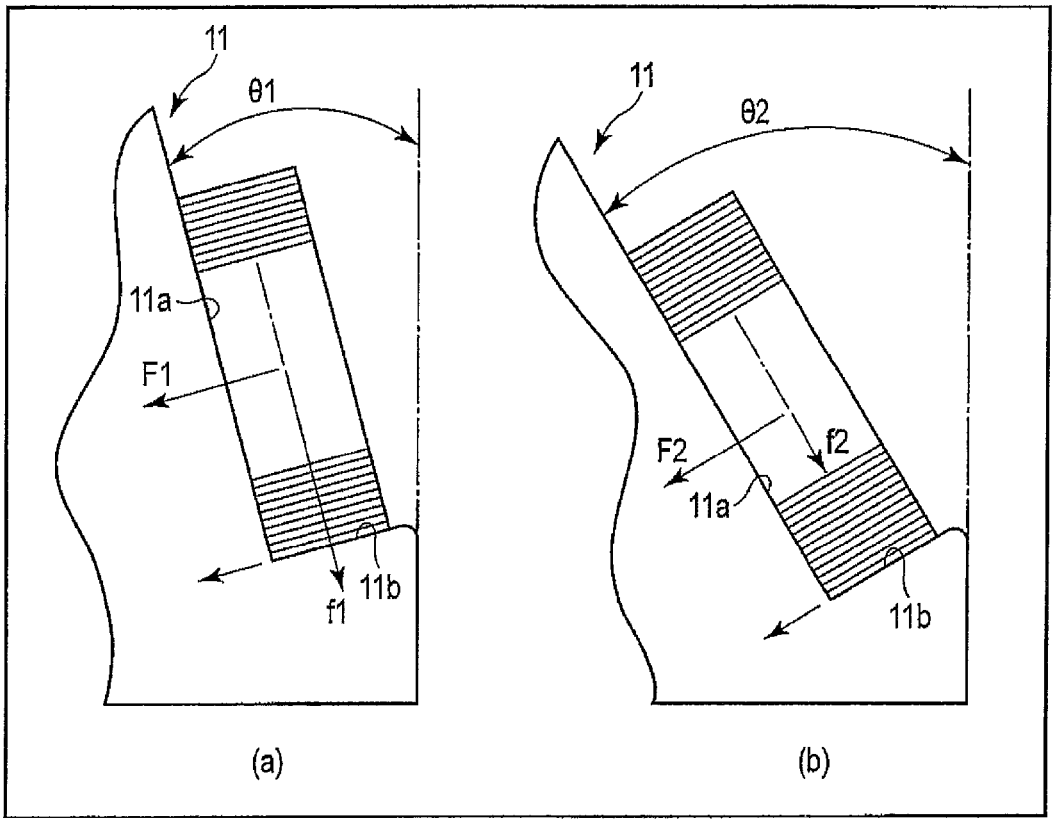
FIG. 6 is a figure schematically illustrating the feeding unit in which an inclination angle of a support surface is different.

FIG. 6(*a*) shows a case where the support surface 11*a* is inclined by the angle θ1 of 20 degrees with respect to a vertical direction. FIG. 6(*b*) shows a case where the support surface 11*a* is inclined by the angle θ2 of 30 degrees. When the inclination angle of the support surface 11*a* is increased, and the pick up angle of the bill P is reduced, the weight applied onto the stacking surface 11*b* by the accumulated bills P decreases (f1>f2), and the friction between the bills P in the stacking direction decreases. In this case, even when about 2000 bills P are stacked on the feeding unit 11, the bills P can be picked up in a stable manner.

On the other hand, when the inclination angle of the support surface 11*a* is increased, and the pick up angle of the bill P is reduced, the weight applied onto the support surface 11*a* by the accumulated bills P increases (F1<F2), and the friction between the side edges of the bills P and the support surface 11*a* increases. Even when the weight increases by this amount, this hardly affects the pick up process of the bills P. In the present embodiment, however, a pair of protruding ribs 11*d* are provided on the support surface 11*a* in order to further reduce the friction as shown in FIGS. 4 and 5. These ribs 11*d* extend in parallel in the longitudinal direction of the support surface 11*a*, i.e., in the stacking direction of the bills P. The side edges of the stacked bills P placed on the feeding unit 11 are placed on the pair of ribs 11*d*. Therefore, this structure reduces the size of contact area between the bills P and the support surface 11*a*, thus reducing the friction therebetween. When the lowermost bill P of the stacked bills P is successively picked up, the bills P smoothly descends to the side of the stacking surface 11*b* in order.

As shown in FIG. 2, the feeding unit 11 includes a backup plate 21 for moving the stacked bills P to the pick upside, i.e., toward the stacking surface 11*b*. The backup plate 21 is provided so that the backup plate 21 can be accommodated in the support surface 11*a* and can move along the support surface. The backup plate 21 is supported in such a manner that the backup plate 21 can pivot with respect to the support surface 11*a*. For example, when about 2000 bills P are stacked on the feeding unit 11, the backup plate 21 is usually pivoted to a position at which the backup plate 21 is flushed with the support surface 11*a*, and the backup plate 21 is held at that position with a torsion spring. When the pick up process of the bill P continues, and the remaining bills P decreases, e.g., about 800 bills P are remaining, the backup plate 21 is pivoted to a position at which the backup plate 21 vertically rises from the support surface 11*a*, and thereafter, the backup plate 21 comes into contact with the uppermost bill P of the stacked bills P. Then, the backup plate 21 as well as the stacked bills P move to the pick up side. In this structure, the backup plate 21 can move the stacked bills P to the pick up side, and even when there are a few stacked bills P are remaining, the backup plate 21 prevents the bills from falling, and can stably move the backup plate 21 to the pick up position.

Figure 7:
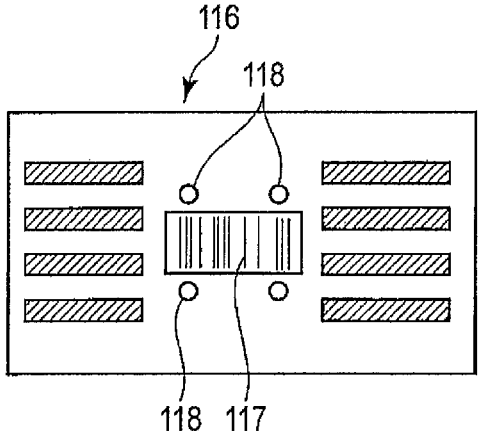
FIG. 7 is a plan view illustrating a batch card used in the bill processing apparatus.

The sheets stacked on the feeding unit 11 may include a batch card 116 as shown in FIG. 7. For example, this batch card 116 is formed in the same external dimension as the bill P, and a front surface or a back surface of the batch card 116 is formed with a bar code 117 representing information about a batch of the bill P. The batch card 116 includes a plurality of detection holes 118. The batch card may be formed to have colors such as red, blue, and green. The batch card 116 is placed on the feeding unit 11 in such a manner that the batch card 116 is stacked at the last of any given batch in the stacked bills P.

Figure 8:
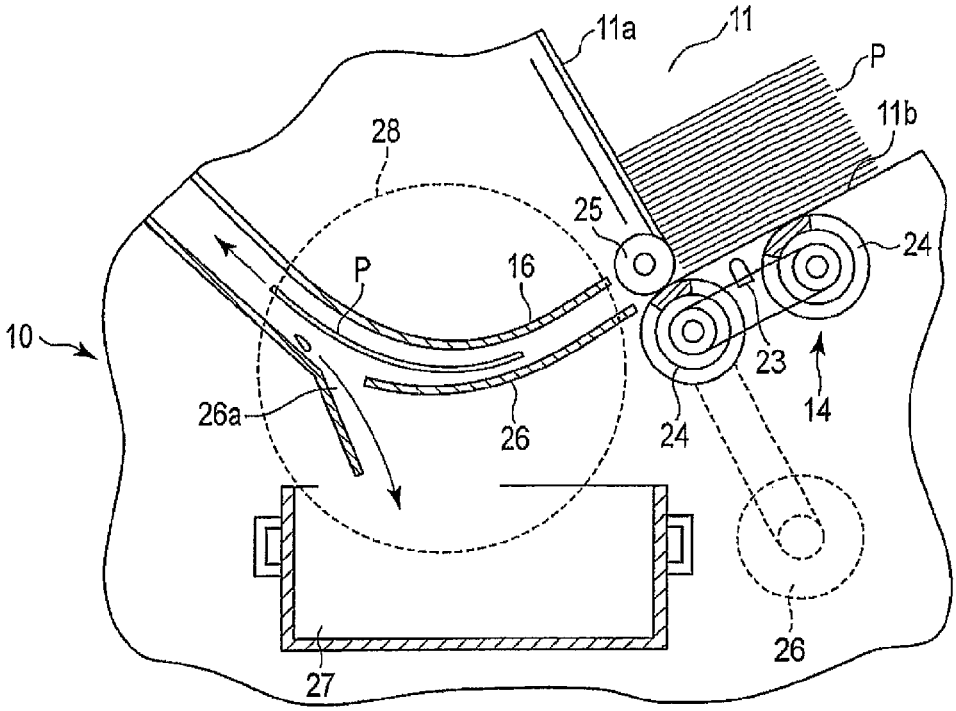
FIG. 8 is an enlarged cross sectional view illustrating a pick up mechanism and a conveying path in the bill processing apparatus.

As shown in FIGS. 2 and 8, the pick up mechanism 14 for picking up the bills P, one by one, from the feeding unit 11 comprises a plurality of pickup rollers (pick up rollers) 24 that can come into contact with the bill P on the stacking surface 11*b*, a separation roller 25 provided in contact with the pickup rollers 24 at the side of the pick up opening 11*e*, and a driving motor 26 for rotating the pickup roller 24 at a predetermined speed.

When the pickup roller 24 rotates, the lowermost bill P is picked up by the pickup roller 24, and the picked up bill P is conveyed from the pick up opening 11*e* to the conveying path 16. At this occasion, the second and subsequent bills P are separated by the separation roller 25 from the picked up bill. Therefore, the bills P are picked up, one by one, from the feeding unit 11, and are conveyed to the conveying path 16.

The main control unit 12 adjusts, in multiple steps, the amount of bills picked up by the pick up mechanism 14 and the pick up speed in accordance with the amount of stacked bills P or in response to an input instruction given by an operator. In other words, the main control unit 12 adjusts the rotating speed of the pickup roller 24 driven by the driving motor 26. For example, the amount of picked up bills is set to 1000, 800, and 600 bills per minute. Further, the main control unit 12 adjusts the amount of picked up bills P in accordance with the inspection state of the inspection device 18, explained later. For example, when the inspection device 18 is unable to inspect the bills P in good condition, the main control unit 12 changes the amount of picked up bills P from 1000 bills per minute to 800 bills per minute. Further, when the inspection device 18 detects any bill P with multi-layered picking-up or short pitch, the main control unit 12 temporarily stops the pickup roller 24 or rotate the pickup roller 24 backward, thereby preventing multi-layered picking-up of the bills P and normalizing the feeding pitch of the bills P.

A sensor, not shown, is provided in proximity to the pick up opening 11*e*. The sensor detects whether there is any bill P on the stacking surface 11*b*. As shown in FIG. 8, when the batch card 116 is used, an RGB sensor 23 is provided to face the stacking surface 11*b*. This RGB sensor 23 detects the color of the sheets, and detects the batch card 26.

As shown in FIGS. 1 and 2, a conveying pitch correction unit 13, the inspection device 18, and a bar code reader 19 are provided along the conveying path 16. The conveying pitch correction unit 13 corrects the conveying pitch of the bills P conveyed in the conveying path 16. The inspection device 18 inspects, one by one, the bills P of which the conveying pitch has been corrected. The inspection device 18 is provided at a position higher than the pick up opening 11*e* of the feeding unit 11 in the vertical direction. The inspection device 18 detects a nominal value, form, a thickness, front/back, authentic/counterfeit, damaged or not, multi-layered picking-up, and the like about a conveyed bill P. In this case, the detection of damage is processing for distinguishing between a normal bill that can be redistributed and a damaged bill that cannot be redistributed due to smudge, damage, and the like. For example, when the batch card 116 is used, the bar code reader 19 reads the bar code 117 attached to the batch card 116 having passed through the inspection device 18, and transmits the read information to the main control unit 12. Alternatively, an independent bar code reader may not be provided, and the inspection device 18 may be configured to read a bar code.

The conveying path 16 extends downward from the pick up mechanism 14 and the pick up opening 11*e*, and then the conveying path 16 extends upward to the inspection device 18 in a diagonally inclined direction with respect to the vertical direction. According to the present embodiment, the conveying path 16 extends in the inclined direction substantially along the support surface 11*a* of the feeding unit 11, i.e., the conveying path 16 extends in the same inclined direction as the support surface 11*a*. Alternatively, the conveying path 16 may not extend downward from the pick up opening 11*e*, and the conveying path 16 may extend in a diagonally upward direction immediately from the pick up opening. On the other hand, the inspection device 18 is provided in an inclined manner along the conveying path 16.

As described above, the conveying path 16 extends diagonally from the lower portion to the upper portion. In this structure, even when foreign matters such as a clip, a coin, and a pin are picked up into the conveying path 16 together with the bill P from the feeding unit 11, the picked up foreign matters drop into the lowermost portion of the conveying path along the conveying path 16 due to the gravity of the foreign matters. Therefore, the foreign matters are rejected before they enter into the inspection device 18, and this prevents damage of the inspection device 18 that may be caused by the foreign matters.

As shown in FIGS. 2 and 8, in a lowermost portion of the conveying path 16, a discharge opening 26*a* is formed in a guide plate 26 that defines the conveying path 16. In addition, a foreign matter collection unit is provided below the discharge opening 26*a*. The foreign matter collection unit is made with a collection box 27 that can be pulled out of the main body of the apparatus, for example. The foreign matters dropped along the conveying path 26 are discharged from the discharge opening 26*a*, and are collected in the collection box 27.

Figure 9:
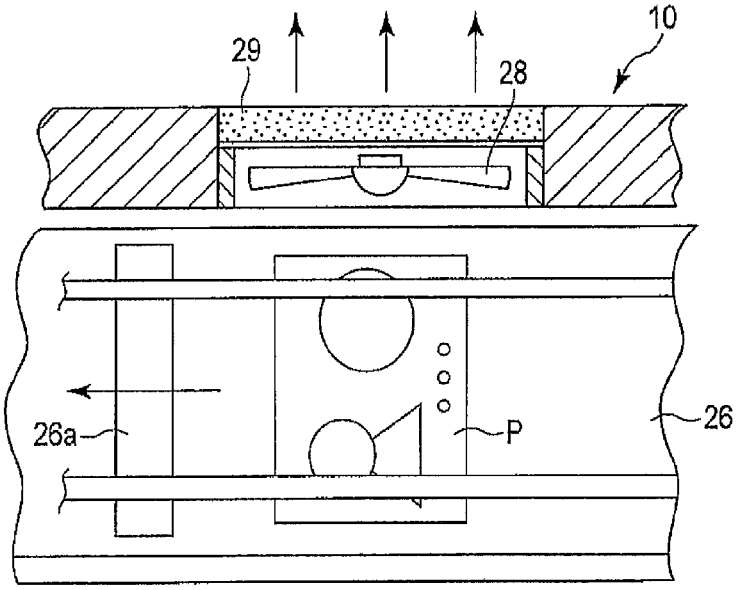
FIG. 9 is a cross sectional view illustrating an intake fan and a lowermost portion of the conveying path.

As shown in FIGS. 8 and 9, an intake fan 28 is provided to face the lowermost portion of the conveying path 16, and further a dust collection filter 29 is provided at the exhaust side of the intake fan 28. The intake fan 28 sucks air in the lowermost portion of the conveying path 16, whereby paper powder, dust particles, generated in the conveying path 16 are removed from the conveying path 16, and captured by the dust collection filter 29. Accordingly, this prevents contamination of the conveying path 16 caused by paper powder and the like, and prevents deterioration of the inspection accuracy in the inspection device 18.

As shown in FIGS. 1 and 2, in the main module 10, two rejection units 20*a* and 20*b* are provided along the conveying path 16, and a plurality of accumulation containers 22*a*, 22*b*, 22*c*, and 22*d* for respectively accumulating the bills are arranged side by side. The bills P having passed through the inspection device 18 are classified by a gate, not shown, into rejected bills and processed bills. The rejected bills include a bill determined to be a counterfeit bill by the inspection device 18 and a bill that cannot be distinguished by the inspection device 18 because it is bent, torn, skewed, or multi-layered picking-up. A skewed bill P is a bill P diagonally inclined with respect to the direction perpendicular to the conveying direction. The rejected bills are distributed and accumulated in the rejection unit 20*a* or 20*b*. The rejected bills accumulated in the rejection unit 20*a* or 20*b* except the counterfeit bills are set on the feeding unit 11 again to be picked up again. Alternatively, number counting data may be manually input to be added to calculation. The inspection result such as the processed amount of bills, the number of processed bills, and the like output from the inspection device 18 is transmitted to the main control unit 12 to be saved, and is displayed on the monitor 15.

The processed bills include a non-damaged authentic bill P and a damaged authentic bill P which are distinguished by the inspection device 18. The processed bills are conveyed and accumulated in the accumulation containers 22*a* to 22*d*. For example, the processed bills are distributed and accumulated in the accumulation containers 22*a* to 22*d* each corresponding to a nominal value. The damaged bills are accumulated in one accumulation container.

When the above batch card 116 is used, the batch card 116 passes through the inspection device 18 and the bar code reader 19 and thereafter conveyed and accumulated in the rejection unit 20*a* or 20*b*.

The conveying path 16 is connected to the loading module 30 explained later. When bills are loaded to the loading container by the loading module 30, some or all of the processed bills inspected by the inspection device 18 of the main module 10 are conveyed to the loading module 30 via the conveying path 16.

The main module 10 includes a driving mechanism, not shown, for driving the pick up mechanism 14, the inspection device 18, the conveying mechanism, and the like, a power supply, and other various kinds of sensors.

As shown in FIGS. 1 and 2, the loading module 30 includes an attaching unit 34 detachably attached to loading containers 32 such as ATM cassettes and loading cassettes, detached from the automatic teller machine (ATM), a loading/pick-up mechanism 36 for loading bills to the loading container 32 or unloading bills from the loading container 32, an inspection device 38, a rejection container 40, an arrangement mechanism 42, and a conveying path 44 for conveying bills via the above listed elements. A plurality of pairs of endless conveying belts are provided to extend along the conveying path so as to sandwich the conveying path 44. The bills are conveyed while being sandwiched between the conveying belts. The conveying path 44 includes a first conveying path 44*a* and a second conveying path 44*b*. The first conveying path 44*a* extends from the conveying path 16 of the main module 10 to a strapping module 60*a*. The second conveying path 44*b* extends from the first conveying path, passes in proximity to the attaching unit 34, the inspection device 38, and the rejection container 40, and returns back to the first conveying path.

The loading containers 32 attached to the attaching unit 34 include a loading container for only loading (depositing) bills, a loading container for only unloading (withdrawing) bills, and a loading container for both loading and unloading (depositing/withdrawing) bills. In this case, the loading container 32 is configured such that many bills can be loaded as well as bills can be unloaded from the loading container. The loading container 32 includes a sensor for detecting loading/unloading of bills and a memory storing information such as a nominal value of loaded bills, the amount of bills (balance), operator information, an ID of the loading container 32 (index representing a branch code and a loading container), and machine serial number.

Figure 10:
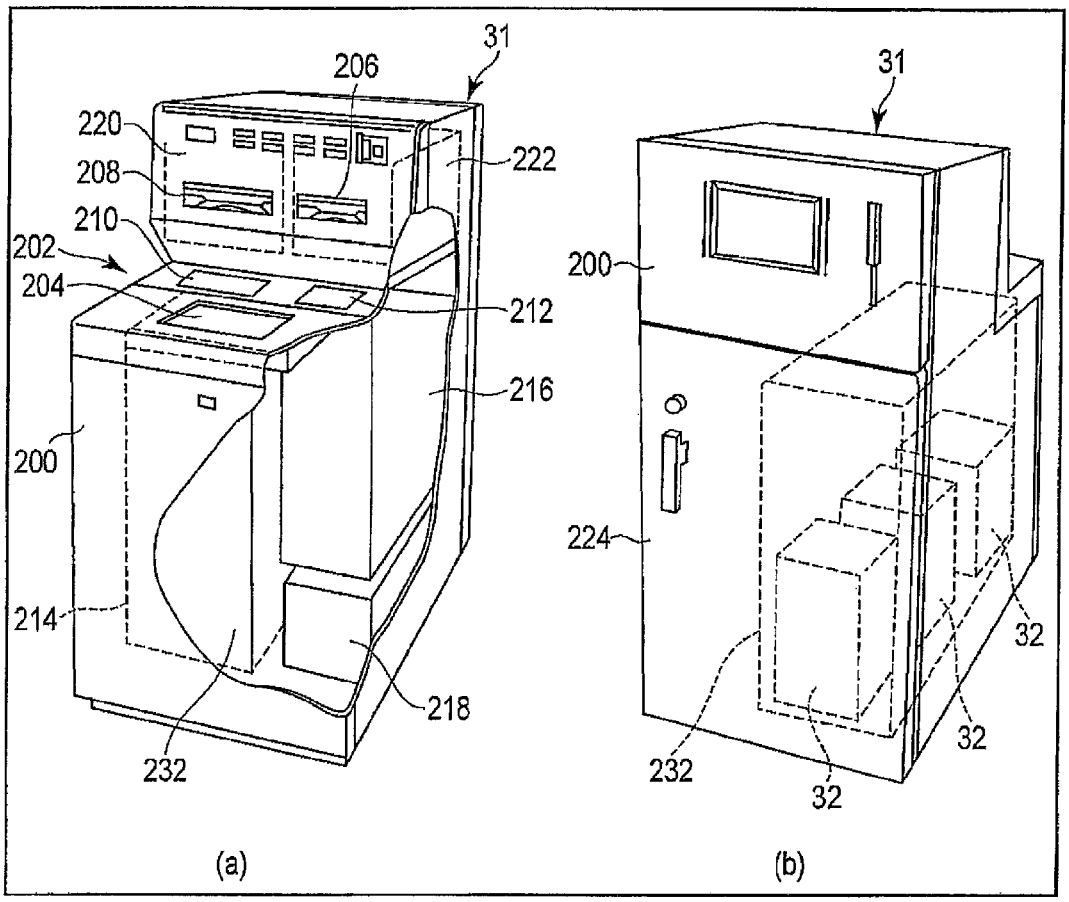
FIG. 10 is a perspective view illustrating an automatic teller machine.
Figure 11:
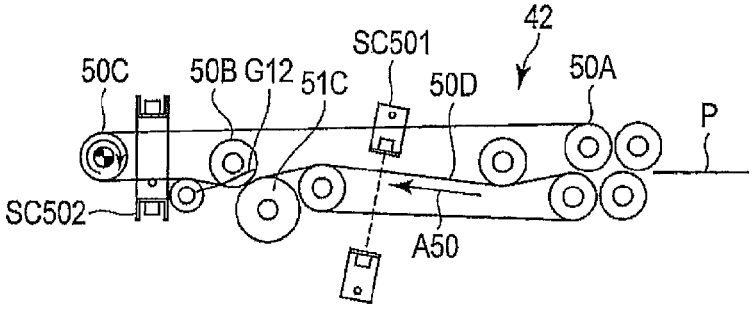
FIG. 11 is a side view illustrating an arrangement mechanism of the loading module of the bill processing apparatus.
Figure 12:
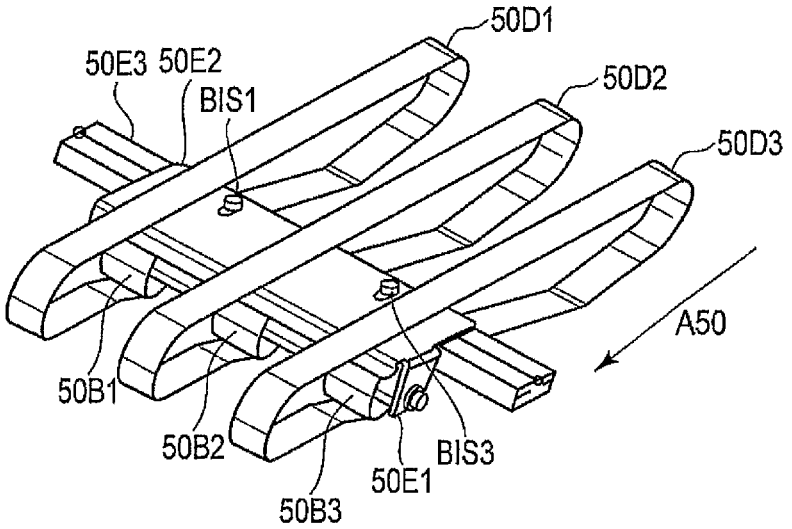
FIG. 12 is a perspective view illustrating the arrangement mechanism.
Figure 13:
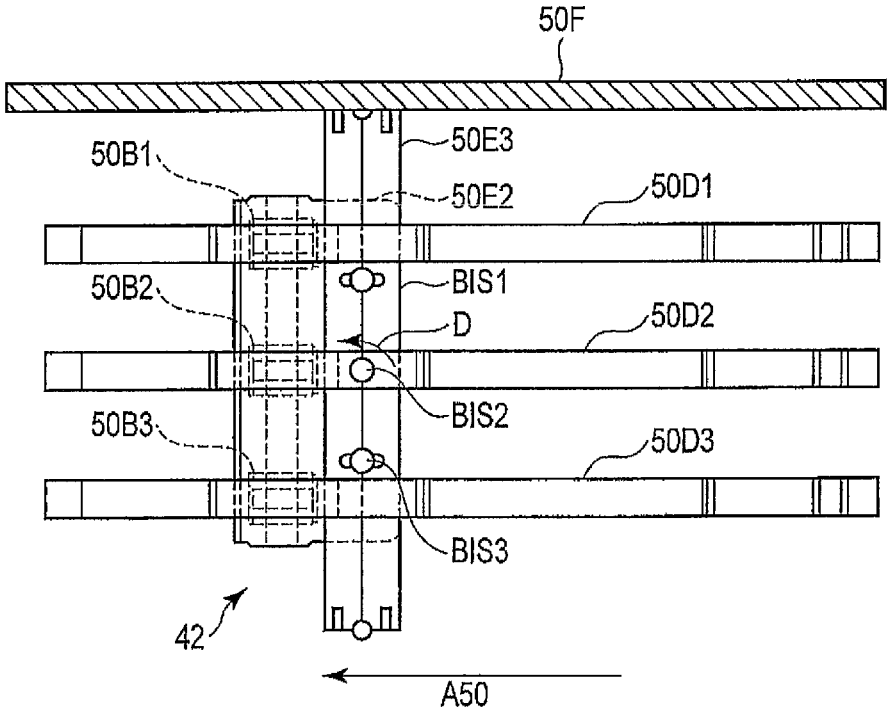
FIG. 13 is a plan view illustrating the arrangement mechanism.
Figure 14:
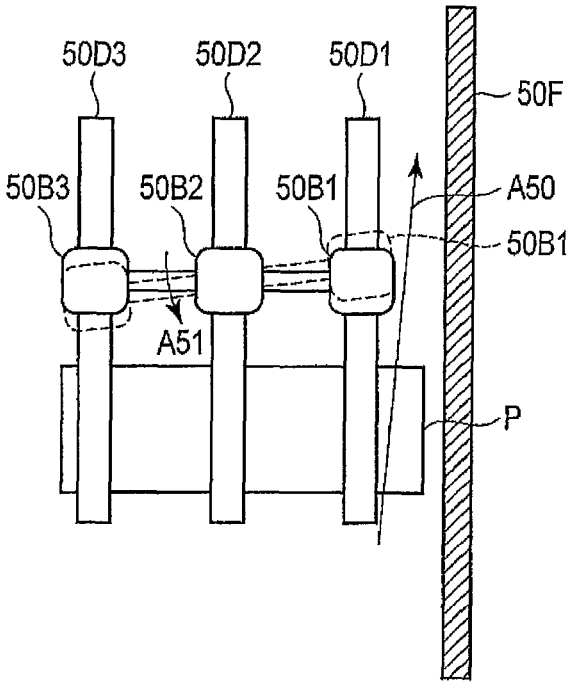
FIG. 14 is a plan view illustrating bill arrangement operation in the arrangement mechanism.

FIG. 10 illustrates an example of an automatic teller machine (ATM). This ATM 31 includes a main body 200 substantially in a rectangular box shape. On a front surface of the main body, the ATM 31 includes a customer operation panel 202 substantially in an L-shape to face a user. A display unit 204 also serving as a touch panel is provided on a horizontal portion of the customer operation panel 202. A card insertion opening 206, a bankbook insertion opening 208, and the like are provided on a vertical portion of the customer operation panel 202. A bill depositing/withdrawing opening 210 and a coin depositing/withdrawing opening 212 are provided at a corner portion of the customer operation panel 202. Each of the bill depositing/withdrawing opening 210 and the coin depositing/withdrawing opening 212 includes a lid that can open and close.

The main body 200 is provided with a bill handling device 214 for allowing a user to deposit/withdraw bills via the bill depositing/withdrawing opening 210, a coin handling device 216 for depositing/withdrawing coins via the coin depositing/ withdrawing opening 212, a control unit 218, a bankbook printer 220, a card/payment slip processing device 222, and the like.

An openable and closable door 224 is provided on a back surface of the main body 200 to allow the bill handling device 214 and the coin handling device 216 to be detached from the main body. The door 224 is formed with an insertion opening 226 facing a bill conveying portion of the bill handling device 214 explained later, and the insertion opening 226 is opened and closed by a door 228 opening vertically. A connector 230 is provided on a back surface of the bill handling device 214, and the connector 230 faces the insertion opening 226.

As shown in FIG. 10, the bill handling device 214 includes a long and narrow casing 232. For example, two loading containers for accommodating ten-thousand-yen bills and a loading container for accommodating thousand-yen bills are arranged side by side as the loading containers 32 in the casing. These loading containers 32 can be detached from the casing 232 or attached to the casing 232 by opening the door 224 and pulling out the casing 232. In addition to the above, the casing 232 includes, e.g., a bill accumulation unit for receiving bills inserted via the bill depositing/withdrawing opening 210 and providing the withdrawn bills, a deposition temporary accumulation unit for temporarily accumulating deposited bills, an inspection unit for inspecting deposited bills and withdrawn bills, a pair of rejection containers for accommodating rejected bills, and a collection container for accommodating damaged bills.

The loading container 32 detached from the ATM 31 is detachably attached to the attaching unit 34 of the loading module 30 as shown in FIG. 2. When the loading container 32 is attached to the attaching unit 34, the loading container 32 is connected to the loading/pickup mechanism 36, and the loading container 32 is connected to a control unit of the loading module 30 via the connector 46. Information stored in the memory of the loading container 32 is transmitted to the main control unit 12 via the connector 46 and the LAN. A Radio Frequency Identification (RFID) such as a wireless IC tag may be attached to the loading container 32, and the information, about the loading container 32 may be transmitted to the loading module 30 and the main control unit 12 via a wireless communication.

The loading/pick-up mechanism 36 of the loading module 30 includes a pick up roller for picking up bills from the loading container 32 one by one, a loading roller for loading bills to the loading container 32 and a conveying belt.

The inspection device 38 detects a nominal value, a form, a thickness, front/back, authentic/counterfeit, damaged or not, multi-layered picking-up, a bill serial number, and the like about a conveyed bill picked up from the loading container 32. In this case, the detection of damage is processing for distinguishing between a normal bill that can be redistributed and a damaged bill that cannot be redistributed due to smudge, damage, and the like. The damaged bill includes a bill to which an adhesive tape is adhered. For example, the authentic/counterfeit detection may use magnetic detection, image detection, or fluorescence detection in which fluorescent light is emitted and reflection light is read. The inspection device 38 counts the number of picked up bills, and calculates the number of bills and the balance. The inspection result such as the balance and the number of bills detected by the inspection device 18 is transmitted to the main control unit 12 to be saved, and is displayed on the monitor 15.

The rejection container 40 is provided at a downstream side of the inspection device 38 in the conveying direction of the bills. The bills P having passed through the inspection device 38 are classified by a gate, not shown, into rejected bills and processed bills. The rejected bills include a bill determined to be a counterfeit bill by the inspection device 38 and a bill that cannot be distinguished by the inspection device 38 because it is bent, torn, skewed, or multi-picked up. The rejected bills are conveyed and accumulated in the rejection container 40. Alternatively, any one or a plurality of accumulation containers 22*a* to 22*d* of the main module 10 may be set as a rejection container under the control of the main control unit 12 in advance, and rejected bills discharged from the loading module 30 may be conveyed and accumulated in the rejection container of the main module 10. The rejected bills having passed through the inspection device 38 may be further separated into rejected bills determined to be counterfeit bills and the other rejected bills, which may be separately accumulated in separate rejection containers.

The processed bills include a non-damaged authentic bill P and a damaged authentic bill P which are distinguished by the inspection device 38. The non-damaged bill is returned back to the loading container 32 via the conveying path 44*b* and the arrangement mechanism 42, and is loaded to the loading container 32 by a loading/pick-up mechanism 36. Alternatively, any one or a plurality of accumulation containers 22*a* to 22*d* of the main module 10 may be set as a damaged bill container under the control of the main control unit 12 in advance, and damaged bills discharged from the loading module 30 may be conveyed and accumulated in the damaged bill container of the main module 10.

Any previously-defined number of non-damaged bills picked up from the loading container 32 for each nominal value may be accumulated in the accumulation containers 22*a* to 22*d* of the main module 10. When the number of bills accumulated in the loading container 32 is set, e.g., 2000 is set as the number of bills accumulated in the loading container 32, the number of bills in shortage can be recognized from the number of non-damaged bills detected by the inspection device 38. Bills as many as the number of bills in shortage are provided from the main module 10 to the loading module 30, and the bills are loaded to the loading container 32 via the arrangement mechanism 42 and the conveying path 44. When the loading container 32 is loaded to the attaching unit 34 of the loading module 30, the balance of the bills in the loading container 32 is automatically transmitted to the main control unit 12. Therefore, when the main control unit 12 determines that the transmitted balance is less than a desired balance, the main control unit 12 may automatically provide the bills as many as the number of the bills in shortage from the main module 10 to the loading container 32, and load the bills to the loading container 32.

The bill information loaded from the main module 10 to the loading container 32 is saved in the memory of the loading container 32, and is electronically sealed. When the loading container 32 is taken out of the loading module 30, and the door is opened, door open information and date/time are stored to the memory. A password and an IC card can be used as an electronic seal. When the door of the loading container 32 is opened, operator information of a user who uses an electronic key and an IC card is also stored to the memory. Therefore, the security of the loading container 32 can be enhanced.

The information obtained from the loading container 32 such as information about a branch code of an ATM, operator information, a nominal value, an amount, loading direction, the amount of loaded bills, a route for transporting the loading container is transmitted to the main control unit 12, and is recorded and calculated in the main control unit 12. The operator information includes an operator at an ATM-installed branch and reception operator who sets the loading container 32 to the bill processing apparatus. When the above information about the loading container 32 is managed by the main control unit 12, the security can be enhanced.

On the other hand, when bill strapping processing is enabled, non-damaged bills picked up from the loading container 32 are conveyed to the strapping module 60*a* via the conveying path 44 and the arrangement mechanism 42, and every predetermined number of bills are strapped. The arrangement mechanism 42 aligns the center of a bill conveyed along the conveying path 44 with the center of the conveying path, and corrects a skewed bill so that one side of the bill is in a direction perpendicular to the conveying direction.

FIGS. 11 to 14 illustrate the arrangement mechanism 42. As shown in these figures, in the arrangement mechanism 42, a plurality of conveying rollers are provided upstream and downstream of the conveying path for conveying the bill P in a direction perpendicular to the conveying path, and conveying belts are placed between conveying rollers which are opposite to each other. In the present embodiment, the arrangement mechanism 42 includes a plurality of conveying rollers such as conveying rollers 50A, correction rollers 50B, and conveying rollers 50C, conveying belts 50D1 to 50D3 wound around the conveying rollers, timing sensors SC501 and SC502, and a driving motor (not shown). The conveying rollers 50A are pick up rollers for picking up a bill P into the arrangement mechanism 42. The conveying rollers 50A include three conveying rollers (50A1 to 50A3 not shown) corresponding to the conveying belts 50D1 to 50D3. In this case, the conveying roller 50A is a general term for these three conveying rollers.

The correction rollers 50B are rollers for correcting belt positions of the conveying belts 50D1 to 50D3. The correction rollers 50B include three correction rollers 50B1 to 50B3 corresponding to the conveying belts 50D1 to 50D3. The correction rollers 50B are constituted by idle rollers. In this case, the correction roller 50B is a general term for these three correction rollers 50B1 to 50B.

The conveying rollers 50C are driving rollers for driving the conveying belts 50D. The conveying rollers 50C include three conveying rollers (50C1 to 50C3 not shown) corresponding to the conveying belts 50D1 to 50D3. In this case, the conveying roller 50C is a general term for these three conveying rollers. This is also applicable to the other conveying rollers.

These conveying rollers are supported on a unit base 50F of the arrangement mechanism 42 in cantilever manner. Therefore, the conveying rollers are more likely to bend at a side far from the unit base. The arrangement mechanism 42 includes the correction rollers 50B, a rotating shaft for arranging the correction rollers 50B in the same axis, a base 50E2 holding the rotating shaft, and a stay 50E3 for fixing the base 50E2 on the unit base 50F.

Each of the correction rollers 50B1 to 50B3 is formed in a crown shape (shape in which the diameter of the roller increases from both end portions to the central portion) so that the central portion is higher than both end portions in the surface of each roller. These three correction rollers 50B1 to 50B3 are fixed to the rotating shaft including coaxially arranged bearings, and are respectively arranged to circumscribe the conveying belts 50D1 to 50D3. Both end portions of the rotating shaft are fixed to a base 50E2 by the holder 50E1.

The base 50E2 is fixed on a stick-shaped stay 50E3 protruding from the unit base 50F with screws BIS1 and BIS3. When a screw BIS2 serving as a pivoting axis of the arrangement mechanism 42 is turned, the base 50E2 pivots about the screw BIS2, whereby the positions of the correction rollers 50B1 to 50B3 move as shown in FIG. 7. In the embodiment, portions for attaching the screw BIS2 and the screw BIS3 of the base 50E2 are elongated holes designed in view of a range for pivoting the arrangement mechanism 42 about the screw BIS2.

A method for causing the arrangement mechanism 42 to align a conveyed bill P will be explained. As described above, these conveying rollers 50A to 50C are supported on the unit base 50F in cantilever manner. Therefore, the conveying rollers 50A to 50C are more likely to bend at a side far from the unit base 50F. Due to this bending, the conveying belts 50D meander in a direction indicated by arrows A50 shown in the figures, i.e., a direction from the near side to the far side (the side of the unit base 50F). The bill P sandwiched by the conveying belts 50D are also displaced from the near side to the far side due to this meandering. When the bills P are accumulated in the loading container 32 in this state, the state of accumulation of the bills P deteriorates.

Accordingly, when the screw BIS2 is turned in a direction indicated by arrow A51 as shown in FIG. 7 (clockwise direction), the correction 50B1 to 50B3 move to positions indicated by broken lines. As a result of this move, the conveying belt positions of the conveying belts 50D are corrected to the initial state. When there is no problem with the conveying belt position, the conveying belts 50D are fixed at this position with screws BIS1 and BIS3. The amount of turn of the screw BIS2 is preferably set in a dynamic manner while observing the conveying state of the bills P.

As described above, the central portion of the correction roller is higher due to the crank form. Therefore, when the screw BIS2 is turned in a direction indicated by arrow A51 in the figures, the center of the roller made to be high moves from the unit base 50F to the near side. The conveying belt 50D is known to move to a high position at the center of the roller. Based on this principle, the conveying belts 50D are corrected. In this case, the conveying belt 50D1 is corrected from the side of the unit base 50F to the near side. Likewise, the conveying belt 50D3 is corrected from the near side to the side of the unit base 50F.

The main function of the arrangement mechanism 42 is to prevent a bill from sliding caused by the meandering belt, and to align the center of the bill with the center of the conveying path. When a plurality of modules are connected, and a conveying path increases, the bills are gradually displaced due to the meandering belt during conveying operation. The arrangement mechanism 42 corrects the displacements of the bills, and aligns the bills with the center of the conveying path. The arrangement mechanism 42 causes an inspection line sensor to detect the amounts of skew and slide of the bill in advance. Accordingly, the arrangement mechanism 42 determines the amount of correction and inclines the rollers, thus forcibly correcting the bill.

When the arrangement mechanism 42 is arranged at a portion where the displacement of the position of the conveying belt affects the apparatus most significantly, the arrangement mechanism 42 provides the largest effect. For example, the present embodiment, the arrangement mechanisms 42 are provided at positions before the bill P is conveyed to the loading container 32 and before the bill is conveyed to the strapping module 60*a* as shown in FIG. 2. Therefore, the conveyed bill P is conveyed to the loading container 32 in such a manner that the bill P is aligned with the conveying path 44 by the arrangement mechanism 42, and is accumulated in the loading container 32 in such a manner that the bill P is aligned. In this configuration, the bills are aligned and accumulated to be prepared for subsequent withdrawing.

Therefore, this configuration is useful. The bill P is conveyed to the strapping module 60*a* in such a manner that the bill P is aligned with the conveying path 44 by the arrangement mechanism 42, and the bill P is strapped in the strapping module 60*a*. Since the positions of the bills strapped by the arrangement mechanism 42 are arranged in order, the bills can be accumulated and neatly strapped by the strapping module.

As shown in FIGS. 1 and 2, the strapping module 60*a* serving as an accumulation/strapping device includes a conveying path 62 in communication with the conveying path 44*a* of the loading module 30, a first accumulation device 64*a* and a second accumulation device 64*b* for accumulating a predetermined number of bills conveyed via the conveying path 62, and a strapping device 68 for strapping bills. The strapping device 68 straps a predetermined number of bills, e.g., 100 bills, accumulated by the accumulation device so that the bundle of bills are strapped with a strap. The first accumulation device 64*a* and the second accumulation device 64*b* are arranged in a vertical direction. The strapping device 68 is arranged below the second accumulation device 64. Further, a discharge unit 75 is arranged below the strapping device 68. The discharge unit 75 receives and accumulates the bundle of bills strapped by the strapping device 68.

Each of first and second accumulation devices 64*a* and 64*b* includes a temporary accumulation unit 65 and a bladed wheel accumulation device 66 for accumulating a predetermined number of conveyed bills P, one by one, to the temporary accumulation unit 65. The bladed wheel 66*a* of the bladed wheel accumulation device 66 is configured such that a plurality of blades are incorporated around the rotating shaft, and the bladed wheel 66*a* rotates in synchronization with the conveying process of the bills in such a manner that the conveyed bills P are received between the blades. Using the bladed wheel 66*a*, the bills P are accumulated in the temporary accumulation unit 65 while the bills P are aligned and the kinetic energy of the bill P conveyed at a high speed is absorbed by the bladed wheel 66*a*.

The strapping module 60*a* includes a conveying tray 70 receiving the accumulated bills from each of the first and second accumulation devices 64*a* and 64*b* and capable of moving in vertical and horizontal directions for conveying the accumulated bills to the strapping device 68.

The strapping device 68 includes a strap feeding unit 71 for providing a wrapping strap (first strap) B used to strap a bundle of 100 bills conveyed by the conveying tray 70, a print device 72 for printing desired information onto the provided wrapping strap, a strap wrapping mechanism 73 for wrapping a printed wrapping strap B1 around the bundle of bills, and an adjustment mechanism 76 for adjusting a wrapping position of the wrapping strap B1 with respect to the bundle of bills.

The print device 72 may be an inkjet printer, dot printer, a laser printer, and the like. The print device 72 prints, to the wrapping strap B1 in any language font, any information input from an operator, or an operator ID stored in the memory 12*b*, a date/time, a serial number, assign information, a bank logo, an administrator's signature image, and the like, under the control of the main control unit 12 and the sub-control unit 61*a*.

Figure 15:
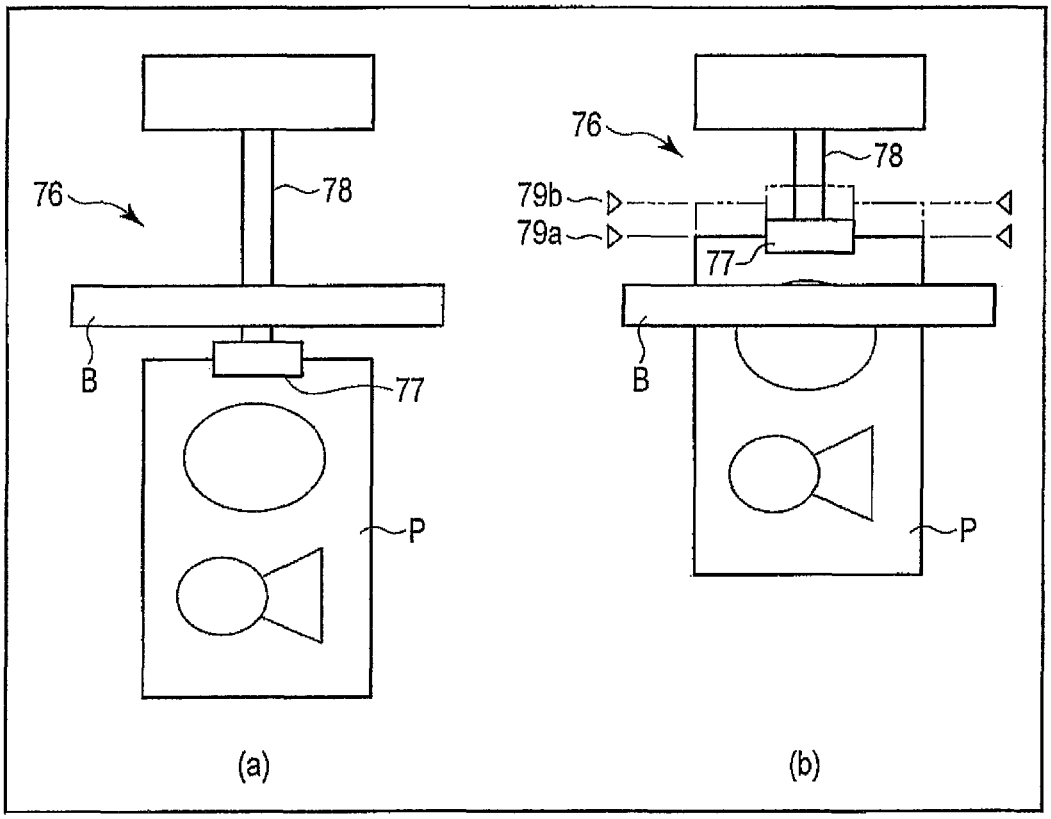
FIG. 15 is a plan view illustrating an adjustment mechanism of a strapping module in the bill processing apparatus.

As shown in FIG. 15, the adjustment mechanism 76 includes a chuck 77 for holding an end portion of the bundle of bills, a plunger 78 for reciprocally moving the chuck 77 in the longitudinal direction of the bundle of bills, and a plurality of position sensors 79*a* and 79*b* for detecting a pull-in positions of the bundle of bills. The adjustment mechanism 76 holds the bundle of bills with the chuck 77, pulls the bundle of bills to any position through the wrapping strap B1 wrapped in an untied loop form, and adjusts the wrapping position of the wrapping strap B1 with respect to the bundle of bills. For example, the position sensors 79*a* and 79*b* detect the pull-in positions of the bundle of bills, and the bundle of bills can be adjusted to these two positions. In the present embodiment, the wrapping position of the wrapping strap B1 is adjusted to a position displaced from the large strap (second strap) for strapping a plurality of bundles of bills.

Figure 16:
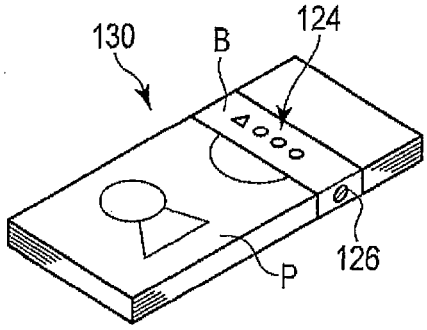
FIG. 16 is a perspective view illustrating a bundle of strapped bills (small bundle)

FIG. 16 is 10 bundles of bills (small bundle) 220 strapped by the strapping module 60*a*. The wrapping strap B1 is wrapped to any position. Desired information 124 is printed on the wrapping strap B1. Further, a confirmation seal 126 of an operator may be attached to a side surface portion of the wrapping strap B1, i.e., a portion extending in a thickness direction of the bundle of bills 130.

As shown in FIG. 2, the bundle of bills 130 accumulated and strapped as described above is discharged to the discharge unit 75, and stacked and stored in order. As described above, the strapping module 60*a* straps, for each nominal value, a predetermined number of non-damaged bills conveyed from the main module 10 or picked up from the loading container 32 and conveyed from the loading module 30, and provides the bundle of bills thus strapped.

Figure 17:
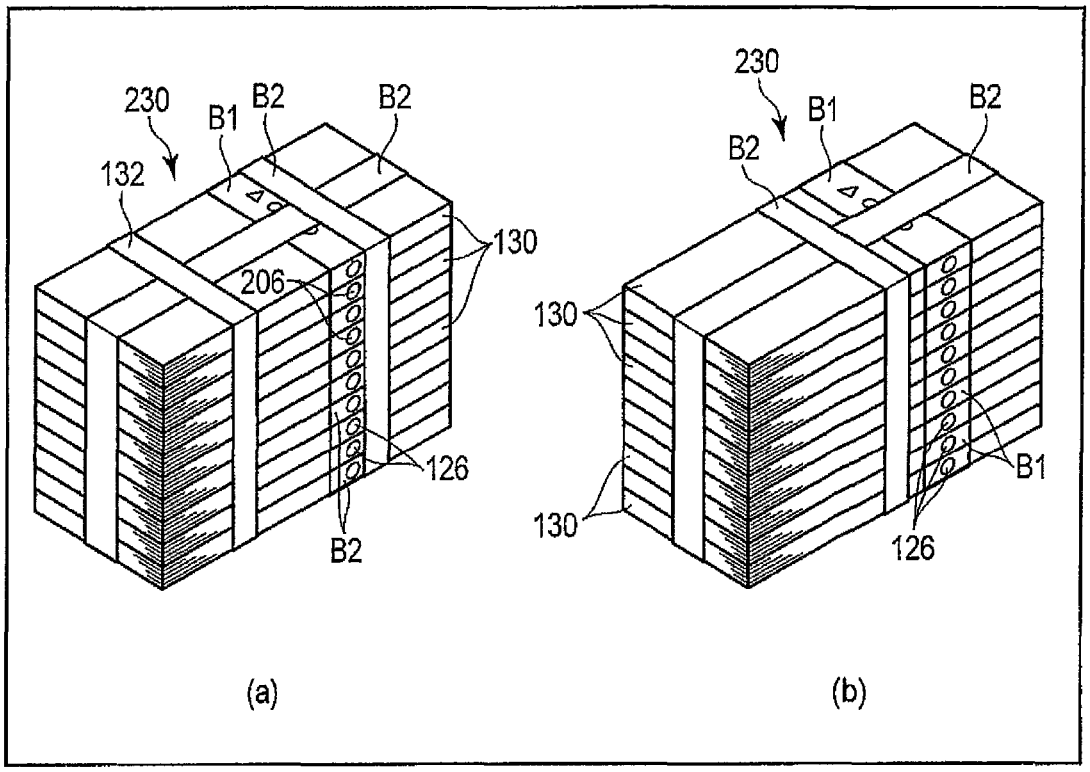
FIG. 17 is a perspective view illustrating a large bundle of bills prepared by stacking and wrapping a plurality of small bundles.

As shown in FIG. 2, the strapping module 60*a* may include a large bundle strapping device 115 for stacking a plurality of bundles of bills 130 stored on the discharge unit 75, strapping the plurality of bundles with a large strap, and forming a large-bundle bill. As shown in FIG. 17, the large bundle strapping device 115 stacks a plurality of bundles of bills 2220, e.g., 10 bundles of bills 2220, straps the plurality of bundles of bills 2220 with a plurality of wrapping straps (second straps) B2, and forms a large bundle 140.

The large bundle 140 as shown in FIG. 17(*a*) is strapped with one wrapping strap B2 in the longitudinal direction and is strapped with two wrapping straps B2 in the lateral direction. The large bundle 140 as shown in FIG. 17(*b*) is strapped with one wrapping strap B2 in the longitudinal direction and is strapped with one wrapping strap B2 in the lateral direction. In any of the large bundles 140, the wrapping strap B1 of each small bundle 130 is wrapped at a position displaced from the wrapping strap B2 of the large bundle 140, i.e., a position that does not overlap the wrapping strap B2. Accordingly, in the large bundle 140, the side surface portion of the wrapping strap B1 of each small bundle 130 is not covered with the wrapping strap B2, and is exposed to the external surface of the large bundle. Therefore, after the large bundle 140 is formed, the confirmation seal 126 can be attached to the side surface portion of the wrapping strap B1 of each small bundle 130. Alternatively, even when the confirmation seal 126 is attached to the side surface portion of the wrapping strap B1 in advance, the confirmation seal 126 can be seen from the outside after the large bundle 140 is formed.

According to the bill processing apparatus, 10 small bundles formed by the strapping module (10 small bundles) may be collected and strapped by the large bundle strapping device with a large strap, whereby a large bundle may be formed, and a radio frequency identification (RFID) tag storing information provided by the bill processing apparatus may be attached to the large bundle, so that information may be linked between the bill processing apparatus and the large bundle.

As shown in FIG. 1, the other strapping modules 60*b* and 60*c* are made in the same manner as the strapping module 60*a*, and the conveying path 62 of each of the strapping modules 60*a*, 60*b*, and 60*c* extends to be in communication with each other. Then, the bill P is conveyed from the main module 10 or the loading module 30 to any one of the strapping modules 60*a*, 60*b*, and 60*c*, and is accumulated and strapped.

A safety pocket 74 is provided at the most downstream portion of all the modules. When there is a bill that could not be processed while conveyed in each module, the bill is discharged to the safety pocket 74, and is taken out of the apparatus.

The loading container 32 from which bills are collected or which is filled with bills by the bill processing apparatus is processed and is thereafter detached from the loading module 30. Then, the loading container 32 is attached to a corresponding ATM.

According to the bill processing apparatus having the above configuration, the loading container 32 detached from an ATM is attached to the attaching unit 34 of the loading module 30, whereby the bills in the loading container can be automatically picked up into the bill processing apparatus and arranged in order. When the bills picked up from the loading container 32 are caused to pass through the inspection device 38, the inspection device 38 can determine the nominal value, authentic/counterfeit, damaged or not, and the like, and when the bills are returned back to the loading container, the balance in the loading container can be detected. In other words, detailed inspection processing can be performed. In the detailed inspection processing, the bills in the loading container 32 are inspected in detail, and the bills are returned back to the loading container again. When the bills picked up from the loading container 32 are conveyed to the strapping modules 60*a* to 60*c*, strapping processing can be performed, whereby a small bundle including 100 bills can be made. Further, in a case where the loading container 32 of the automatic teller machine has a loading function, the following processing can be achieved. When the loading container installed in the bill processing apparatus, a desired number of bills of a desired nominal value, conveyed into the main module 10, can be automatically loaded to the loading container. Since these various processings can be performed without opening the door of the loading container 32, the security can be enhanced. Information can be exchanged between the loading container 32 and the bill processing apparatus, and the balance can be managed in a bidirectional manner. In addition, as necessary, a journal printer for printing a transaction journal may be provided in the loading module 30, and the transaction journal may be attached to the loading container 32.

When the loading container 32 attached to the loading module 30 is a loading container dedicated for withdrawing bills, the bills cannot be directly loaded to the loading container by the loading/pick-up mechanism. Accordingly, in this case, the loading module 30 may be provided with a temporary accumulation unit for accumulating bills picked up from the loading container or bills conveyed from the main module 10 and a robot hand for holding, e.g., 500 bills accumulated on the temporary accumulation unit and putting the bills into the loading container 32, so that the loading processing can be performed.

Since the feeding unit 11 of the main module 10 is arranged in an inclined manner with respect to the vertical direction, the friction between the stacked bills is reduced, and slipping, two-sheets feeding, multi-layered picking-up, and the like can be prevented when the bills are picked up. Accordingly, even when many bills are stacked, the bills can be picked up and processed one by one in a stable manner. Therefore, the reliability can be improved. Since the feeding unit 11 is arranged at a relatively low position in the main body of the apparatus, the loading operation of the sheets to the feeding unit 11 can be easily performed.

Further, even when a foreign matter is picked up, the foreign matter can be discharged and removed before the foreign matter is conveyed to, the inspection device. Therefore, this prevents damage of the inspection device caused by the foreign matter, and improves the reliability of the bill processing apparatus.

Subsequently, a bill processing apparatus according to another embodiment will be explained.

Figure 18:
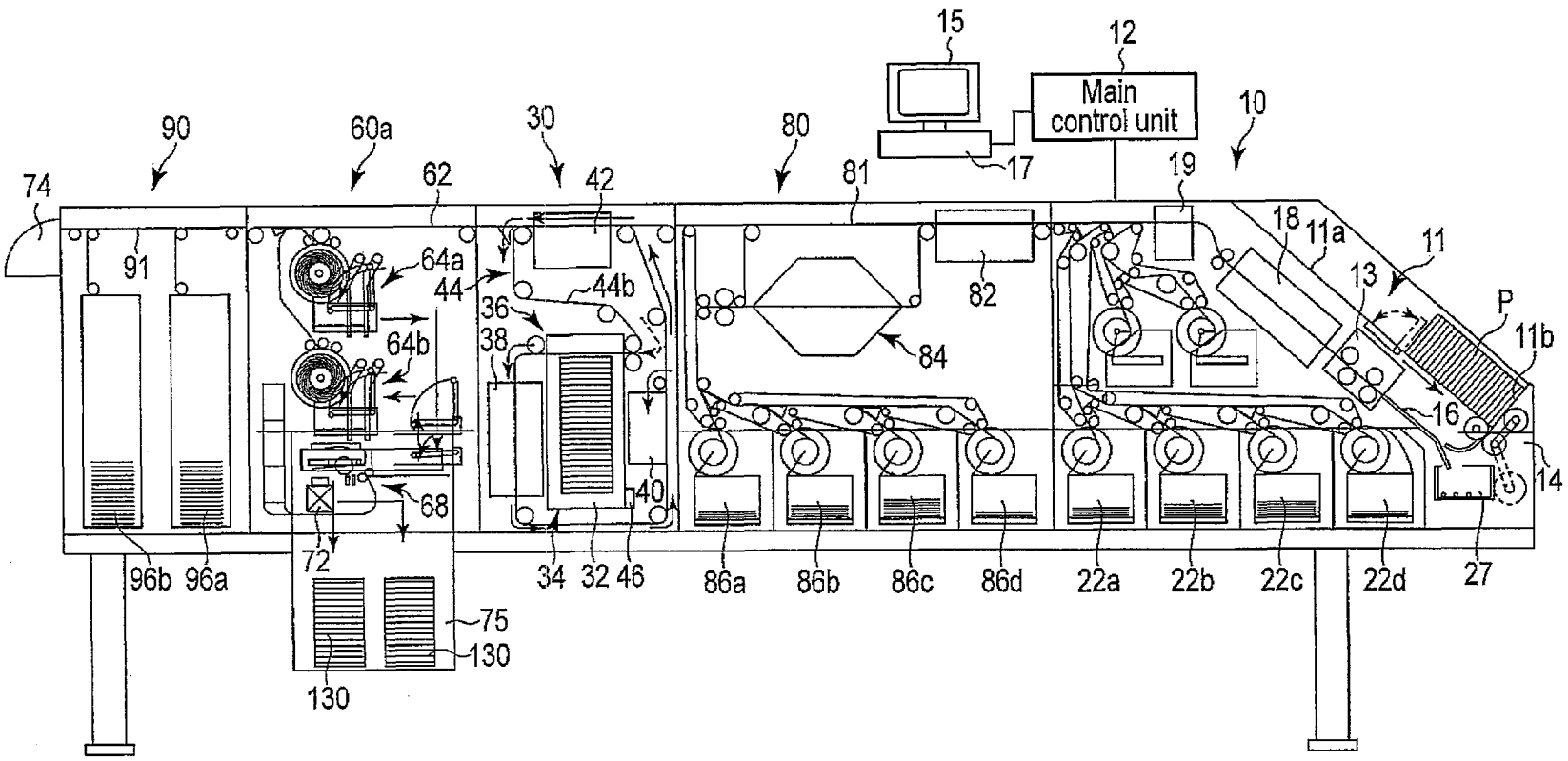
FIG. 18 is a cross sectional view illustrating a bill processing apparatus according to a second embodiment.

FIG. 18 illustrates a bill processing apparatus according to a second embodiment. As shown in FIG. 18, the bill processing apparatus includes a main module 10, an arrangement module 80, a loading module 30, one strapping module 60*a*, and a large capacity accumulation module 90. These modules are arranged in a line in this order, and are connected to each other both electrically and mechanically. The main module 10 includes a main control unit 12 for controlling overall operation of the main module and the entire apparatus.

Each of the main module 10, the loading module 30, and the strapping module 60*a* is made in the same manner as that of the first embodiment. The arrangement module 80 provided between the main module 10 and the loading module 30 includes a conveying path 81 for conveying a bill P from the main module 10, an arrangement mechanism 82 provided at an upstream side of the conveying path 81, a reversing device 84 provided at a downstream side of the arrangement mechanism 82 along the conveying path 81, and a plurality of accumulation containers 86*a*, 86*b*, 86*c*, and 86*d* arranged side by side along the conveying path 81.

The arrangement mechanism 82 is made in the same manner as the arrangement mechanism 42 of the loading module 30. The arrangement mechanism 82 aligns the center of a bill conveyed along the conveying path 81 with the center of the conveying path, and corrects a skewed bill so that one side of the bill is in a direction perpendicular to the conveying direction. The reversing device 84 reverses the direction of the bill P conveyed via the conveying path 81, thereby arranging the front/back or the forward/backward direction of the bill to any specified direction and conveying the arranged bill. The bill P arranged and conveyed by the reversing device 84 is conveyed to the loading module 30 via the conveying path 81, or conveyed and accumulated in any one of the accumulation containers 86*a* to 86*d*. Alternatively, the bill P arranged and conveyed by the loading module 30 may be returned back to the main module 10, and accumulated in the accumulation container 22*a* or 22*d* of the main module.

In the bill loading processing to the loading container 32, the bill P arranged and conveyed from the reversing device 84 is conveyed to the loading module 30 via the conveying path 81, and is accumulated in the loading container 32. At this occasion, the reversing device 84 may actively reverse the direction of the bill to front and back alternately and convey the reversed bill, so that the bills whose front/back sides are arranged alternately are accumulated in the loading container 32. In this case, the bills are less likely to be affected by the recessed from and the frictions between the accumulated bills, and the bills can be easily picked up from the loading container 32.

It should be noted that the accumulation containers 86*a* to 86*d* can also be used as accumulation containers each accumulating bills, of a particular nominal value, picked up from the loading container 32. Alternatively, the accumulation containers 86*a* to 86*d* may be used as rejection containers accumulating rejected bills or damaged bills picked up from the loading container 32, or may be used as damaged bill containers.

The large capacity accumulation module 90 is connected to a downstream side of the strapping module 60*a*. The large capacity accumulation module 90 includes a conveying path 91 for conveying bills P from the strapping module 60*a* and large capacity accumulation containers 92*a* and 92*b* capable of accumulating a certain amount of a certain amount of bills conveyed via the conveying path 91. When a certain amount of bills are manually loaded to the loading container 32, the predetermined amount of bills conveyed from the main module 10 or the loading container 32 are accumulated in each of the accumulation containers 92*a* and 92*b*. Then, the accumulated bills are picked up from the large capacity accumulation containers 92*a* and 92*b* at a time, and are manually loaded to the loading container 32. Accordingly, the certain amount of bills determined in advance can be easily loaded to the loading container 32.

The bill processing apparatus having the above configuration is the same as the first embodiment in that various processings can be performed. For example, bills can be collected from the loading container 32, and bills can be loaded to the loading containers 32. With the arrangement module 80, the bills can be accumulated, loaded, or strapped while the direction of the bills is set in any direction.

Figure 19:
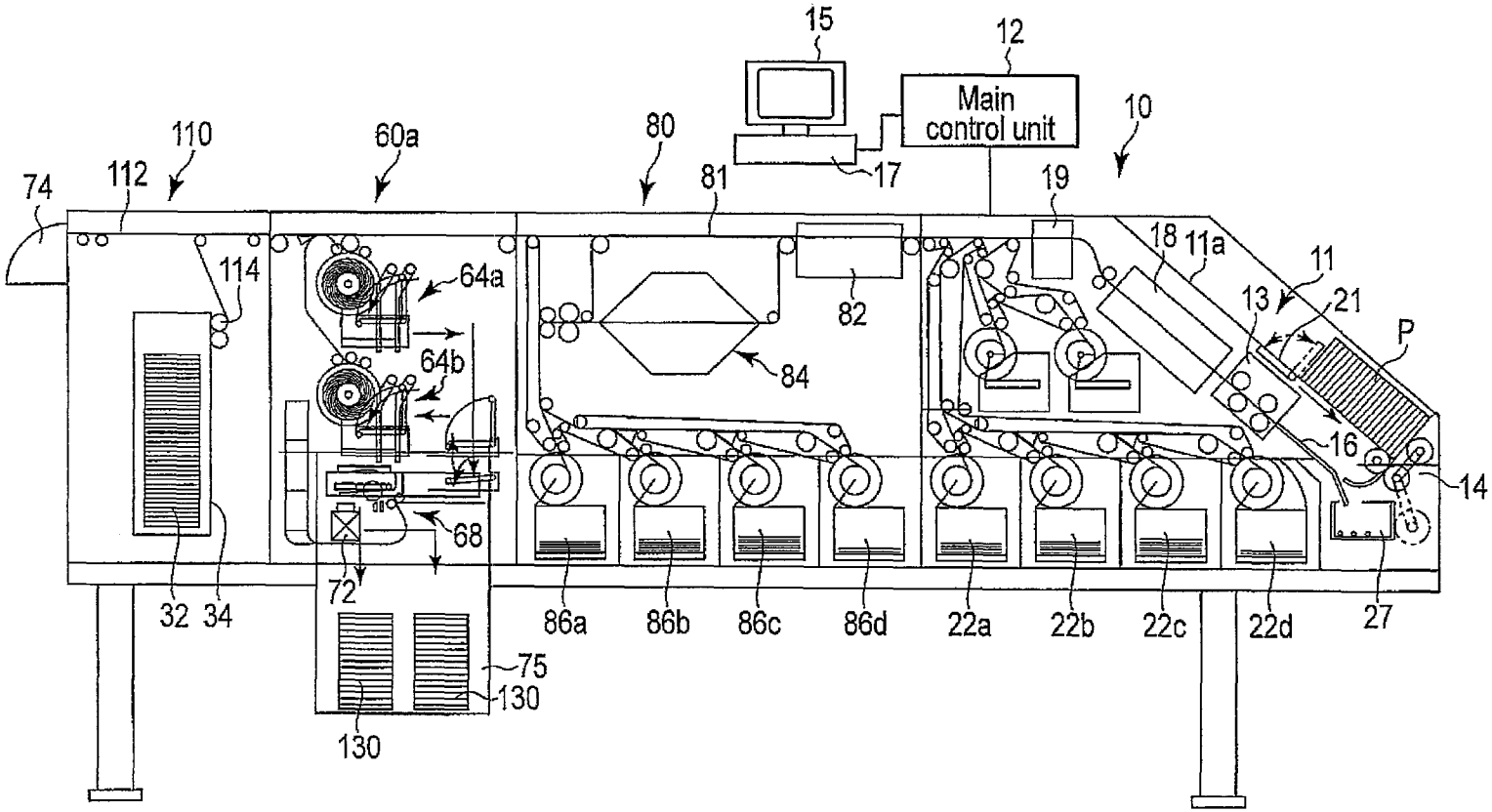
FIG. 19 is a cross sectional view illustrating a bill processing apparatus according to a third embodiment.

FIG. 19 illustrates a bill processing apparatus according to a third embodiment. According to the third embodiment, the bill processing apparatus includes a main module 10, an arrangement module 80, one strapping module 60*a*, and a loading module 110. These modules are arranged in a line in this order, and are connected to each other both electrically and mechanically. The main module 10 includes a main control unit 12 for controlling overall operation of the main module and the entire apparatus.

Each of the main module 10, the arrangement module 80, and the strapping module 60*a* is made in the same manner as that of the first and second embodiments. The loading module 110 connected to a downstream side of the strapping module 60*a* includes an attaching unit 34 detachably attached to a deposit-only loading container or a loading container, for depositing and withdrawing bills to/from an ATM, a conveying path 112 conveying bills from the side of the strapping module 60*a*, and a pick up mechanism 114 for loading the conveyed bills from the conveying path 112 to the loading container 32. The bills P provided to the main module 10 are conveyed to the loading module 110 via the main module 10, the arrangement module 80, and the strapping module 60*a*, and are loaded to the loading container 32.

According to the bill processing apparatus having the above configuration, the inspection device 18 of the main module 10 inspects the bills P, and thereafter the bills P can be accumulated, strapped, or loaded to the deposit-only loading container 32. The bills can be supplied and loaded to the deposit-only loading container 32. In addition, the third embodiment can also achieve the same actions/effects as the first and second embodiments.

Figure 20:
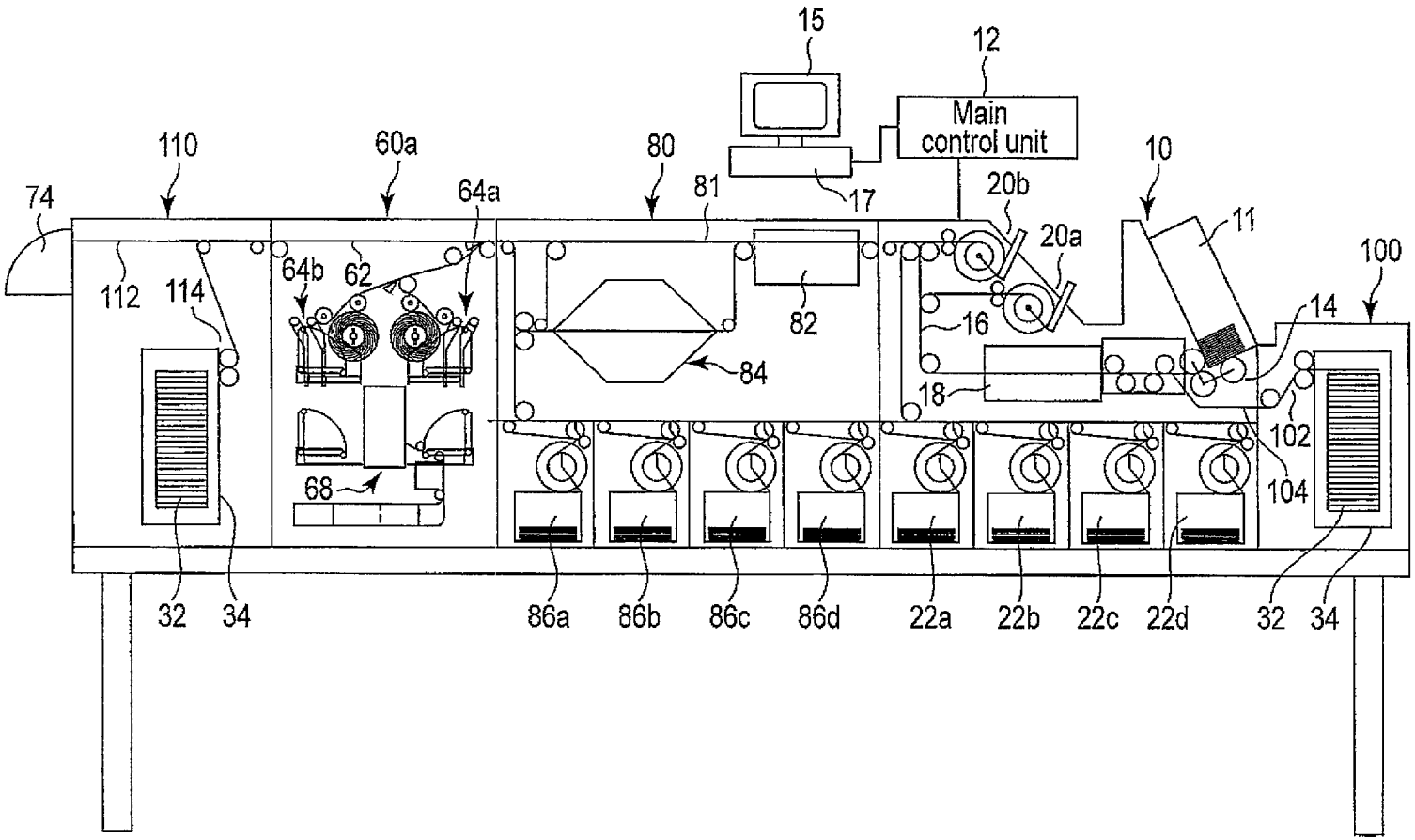
FIG. 20 is a cross sectional view illustrating a bill processing apparatus according to a fourth embodiment.

FIG. 20 illustrates a bill processing apparatus according to a fourth embodiment. According to the fourth embodiment, the bill processing apparatus includes a pick up module 100, a main module 10, an arrangement module 80, one strapping module 60*a*, and a loading module 110. These modules are arranged in a line in this order, and are connected to each other both electrically and mechanically. The main module 10 includes a main control unit 12 for controlling overall operation of the main module and the entire apparatus.

Each of the main module 10, the arrangement module 80, the strapping module 60*a*, the loading module 110 is made in the same manner as that of the first to third embodiments. The pick up module 100 arranged at an upstream side of the main module 10 includes an attaching unit 34 detachably attached to a withdrawing-only loading container or a loading container for depositing and withdrawing bills to/from an ATM, a pick up mechanism 102 for picking up bills from the loading container 32, and a conveying path along which the picked up bills are conveyed. The conveying path of the pick up module 100 is in communication with the conveying path 104 arranged at the side of the pick up mechanism 14 of the main module 10. The bills picked up from the loading container 32 are conveyed to the inspection device 18 via the conveying path 104 of the main module 10. After the inspection, non-damaged bills and damaged bills are accumulated in the accumulation containers 22*a* to 22*d*, or conveyed to the loading module 110 or the strapping module 60*a* via the arrangement module.

The loading module 110 connected to a downstream side of the strapping module 60*a* includes an attaching unit 34 detachably attached to a deposit-only loading container or a loading container for depositing and withdrawing bills to/from an ATM, a conveying path 112 conveying bills from the side of the strapping module 60*a*, and a pick up mechanism 114 for loading the conveyed bills from the conveying path 112 to the loading container 32. The bills provided to the main module 10 or the bills picked up from the loading container 32 by the pick up module 100 are conveyed to the loading module 110 via the main module 10, the arrangement module 80, and the strapping module 60*a*, and are loaded to the loading container 32.

According to the bill processing apparatus having the above configuration, bills are picked up from the loading container 32 dedicated for withdrawing bills, and the bills are inspected by the inspection device 18 of the main module 10. Thereafter, the bills can be accumulated, strapped, or loaded to the deposit-only loading container. The bills can be supplied and loaded to the deposit-only loading container.

Figure 21:
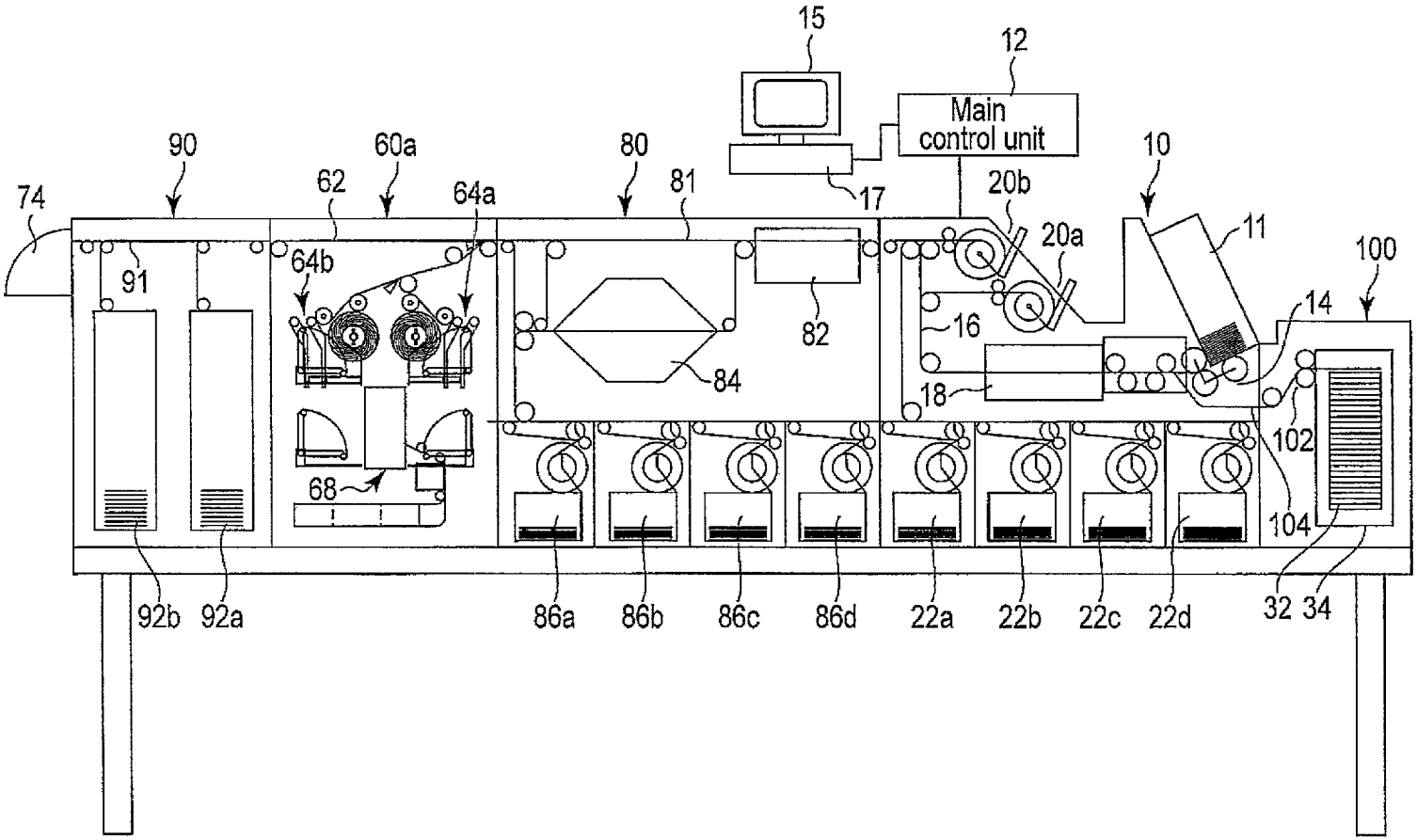
FIG. 21 is a cross sectional view illustrating a bill processing apparatus according to a fifth embodiment.

FIG. 21 illustrates a bill processing apparatus according to a fifth embodiment. According to the fifth embodiment, the bill processing apparatus includes a pick up module 100, a main module 10, an arrangement module 80, one strapping module 60*a*, and a large capacity accumulation module 90. These modules are arranged in a line in this order, and are connected to each other both electrically and mechanically. The main module 10 includes a main control unit 12 for controlling overall operation of the main module and the entire apparatus.

Each of the pick up module 100, the main module 10, the arrangement module 80, and the strapping module 60*a* is made in the same manner as that of the fourth embodiment. The large capacity accumulation module 90 is made in the same manner as that of the second embodiment.

According to the hill processsing apparatus having the above configuration, the bills picked up from the loading container 32 by the pick up module 100 are conveyed to the inspection device 18 via the conveying path 104 of the main module 10. After the inspection, non-damaged bills and damaged bills are accumulated in the accumulation containers 22*a* to 22*d*, or conveyed to the large capacity accumulation module 90 or the strapping module 60*a* via the arrangement module 80.

When a certain amount of bills are manually loaded to the loading container 32, the predetermined amount of bills conveyed from the main module 10 or picked up from the loading container 32 are accumulated in each of the accumulation containers 92*a* and 92*b*. Then, the accumulated bills are picked up from the large capacity accumulation containers 92*a* and 92*b* at a time, and are manually loaded to the loading container 32. Accordingly, the certain amount of bills determined in advance can be easily loaded to the loading container 32.

In the above embodiments, the plurality of modules of the bill processing apparatus are arranged in a line. However the embodiments are not limited thereto. A plurality of modules may be arranged in an L-shape or a U-shape.

Figure 22:
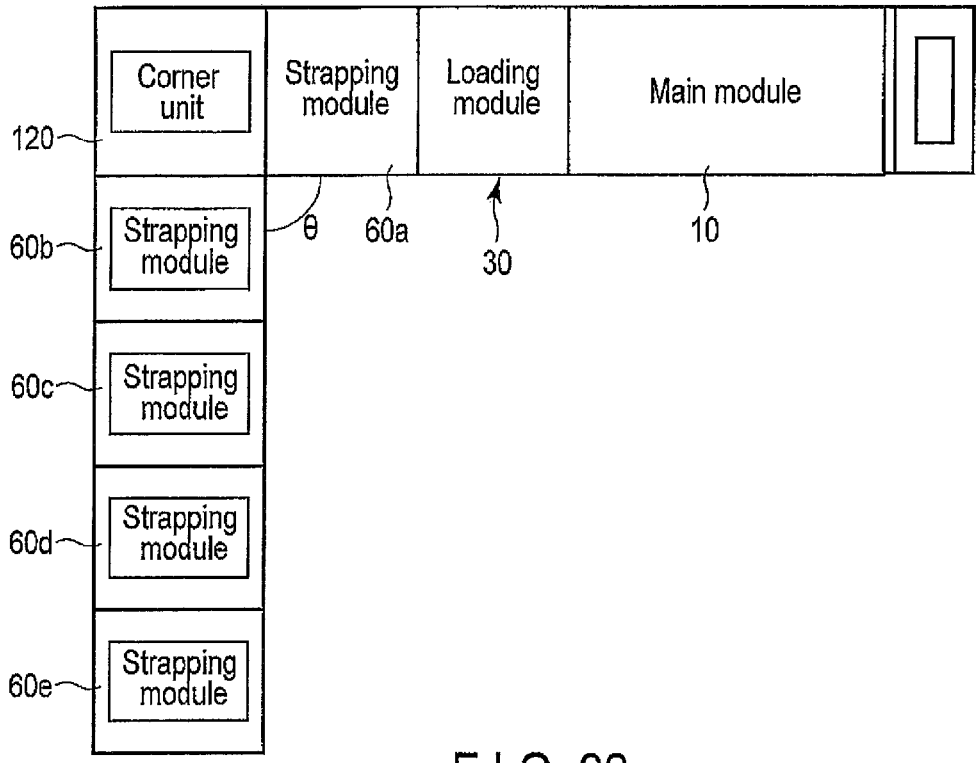
FIG. 22 is a plan view schematically illustrating a bill processing apparatus according to a sixth embodiment.

As shown in FIG. 22, the sixth embodiment is configured such that a main module 10, a loading module 30, and a strapping module 60*a* are arranged side by a side. Four strapping modules 60*b*, 60*c*, 60*d*, and 60*e* are arranged in a line with a corner unit 120 interposed between these strapping modules and the strapping module 60*a*. The four strapping modules 60*b*, 60*c*, 60*d*, and 60*e* are arranged in a direction substantially perpendicular to the row including the main module 10, the loading module 30, and the strapping module 60*a*. In this manner, the plurality of modules are arranged in the L-shape. The configuration of each module is the same as that of the first to fourth embodiments. The corner unit 120 includes a conveying path for conveying bills and a rotation mechanism for rotating a bill from a substantially horizontal state to a vertical state so as to allow the bill to move through the corner portion. An interior angle θ of the corner portion of the module array is set at 45 to 135 degrees, for example.

Figure 23:
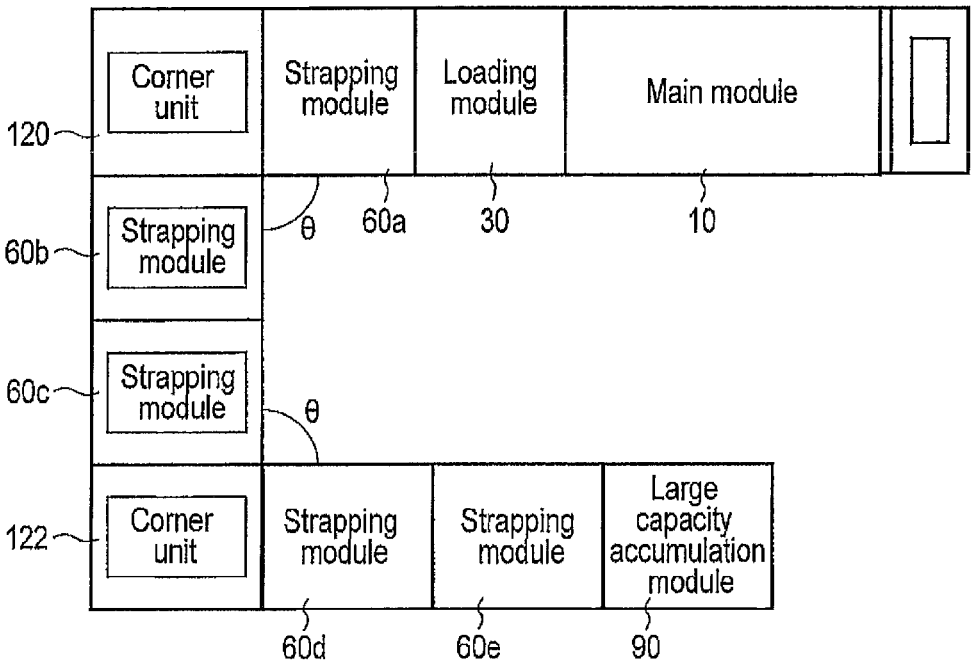
FIG. 23 is a plan view schematically illustrating a bill processing apparatus according to a seventh embodiment.

As shown in FIG. 23, a seventh embodiment is configured such that a main module 10, a loading module 30, and a strapping module 60*a* are arranged side by side in a line. Two strapping modules 60*b* and 60*c* are arranged in a line with a corner unit 120 interposed between these strapping modules and the strapping module 60*a*. The two strapping modules 60*b* and 60*c* are arranged in a direction substantially perpendicular to the row including the main module 10, the loading module 30, and the strapping module 60*a*. Further, two strapping modules 60*d* and 60*e* and a large capacity accumulation module 90 are arranged in a line with a corner unit 122 interposed between these strapping modules and the strapping module 60*c*. The two strapping modules 60*d* and 60*e* are arranged in a direction substantially perpendicular to the row including the strapping modules 60*b* and 60*c*. In this manner, the plurality of modules are arranged in the U-shape. The configuration of each module is the same as that of the first to fourth embodiments. Each of the corner units 120, 122 includes a conveying path for conveying bills and a rotation mechanism for rotating a bill from a substantially horizontal state to a vertical state so as to allow the bill to move through the corner portion. An interior angle θ of each of the two corner portions of the module array is set at 45 to 135 degrees, for example.

According to the sixth and seventh embodiments, even when the bill processing apparatus includes the plurality of modules, the plurality of modules are arranged in the L-shape or the U-shape. Therefore, the plurality of modules can be arranged relatively close to each other, and the ease of operation can be enhanced.

The present invention is not limited to the above embodiments. When the present invention is carried out, constituent elements can be changed and embodied without deviating from the gist of the present invention. Further, various inventions can be formed from an appropriate combination of the plurality of constituent elements disclosed in the above embodiments. For example, several constituent elements may be removed from all the constituent elements shown in the embodiments. Still further, constituent elements in different embodiments may be combined as necessary.

For example, the number of connected modules in the first to seventh embodiments is not limited to those disclosed in the above embodiments. The number of modules may be increased or decreased as necessary, and the types of modules can be selected from various options.

According to the plurality of embodiments described above, the sheet processing apparatus and the sheet processing method capable of performing various kinds of processing including collection and supply of sheets to/from containers in the automatic teller machine can be provided. In addition, the highly-reliable sheet processing apparatus capable of stably performing processing for picking up loaded sheets can be provided.

While certain embodiments have been described, these embodiments have been presented by way of example only, and are not intended to limit the scone of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the processed sheets are not limited to a bill and a batch card. The present invention may also be applied to other sheets such as casino cards and securities.

What is claimed is:

1. A sheet processing apparatus, comprising:

a feeding unit comprising a support surface inclined with respect to a vertical direction, and a stacking surface substantially perpendicular to the support surface and configured to receive a plurality of paper sheets, which tilt along the support surface and are stacked on the stacking surface;

a pick up mechanism configured to pick up the paper sheets from a side of the stacking surface of the feeding unit;

a conveying path configured to convey the picked up paper sheets;

an inspection device configured to inspect the conveyed paper sheet and provided at a position higher than the pick up mechanism in the vertical direction; and an accumulation unit configured to accumulate the inspected paper sheets, wherein the conveying path extends upward from the pick up mechanism to the inspection device along the support surface and tilts from the pick up mechanism to the inspection device obliquely from the vertical direction, and the inspection device is provided diagonally along the conveying path.

2. The sheet processing apparatus according to claim 1, wherein the support surface of the feeding unit is inclined in a range of 25 to 75 degrees with respect to the vertical direction.

3. The sheet processing apparatus according to claim 2, wherein the feeding unit comprises a plurality of ribs which are provided on the support surface to extend in a stacking direction of the paper sheets, and are configured to come into contact with a side edge of the paper sheet.

4. The sheet processing apparatus according to claim 1, further comprising:

a foreign matter collection unit provided below a lowermost portion of the conveying path, wherein the conveying path includes a discharge opening for discharging a foreign matter taken out of the conveying path to the foreign matter collection unit.

5. The sheet processing apparatus according to claim 4, further comprising:

a fan configured to suck air from the lowermost portion of the conveying path; and a dust collection filter provided on a discharge side of the fan.

6. The sheet processing apparatus according to claim 1, wherein the pick up mechanism comprises:

a pick up roller configured to pick up a paper sheet at the lowermost portion of the sheets stacked on the feeding unit; and a control unit configured to adjust a pick up speed of the pick up mechanism to one of predetermined speeds in accordance with an inspection state in which the inspection device inspects the sheet.

7. The sheet processing apparatus according to claim 6, wherein when the inspection device detects a multi-layered picking-up of paper sheets or short pitch of paper sheets, the control unit temporarily stops the pick up roller or rotates the pick up roller backward.

8. The sheet processing apparatus according to claim 1, wherein the feeding unit comprises a backup plate arranged to be movable along the support surface and can be accommodated in the support surface, wherein the backup plate is configured to press the stacked sheets toward the stacking surface when a number of stacked paper sheets is equal to or less than a predetermined number.

9. The sheet processing apparatus according to claim 1, further comprising:

an accumulation/strapping device configured to accumulate and strap a plurality of paper sheets conveyed from the inspection unit, wherein the accumulation/strapping device comprises:

a first strapping device configured to form a small bundle by accumulating a predetermined number of paper sheets and strapping the paper sheets with a first strap; and a second strapping device configured to form a large bundle by accumulating a plurality of small bundles and strapping the small bundles with a second strap, and the first strapping device comprises an adjustment mechanism configured to change a pull-in position of the bundle to adjust a wrapping position of the first strap to a position other than the second strap.

10. The sheet processing apparatus according to claim 9, further comprising:

a print device configured to print information on the first strap of the strapped small bundle; and a control unit configured to store print information including an operator ID, a date/time, a serial number, assign information, a bank logo, an administrator's signature image, and a font of each language, and to provide the print information for the first strap to the print device.

11. The sheet processing apparatus according to claim 1, further comprising:

a display device configured to display information including a processing state; and a control device configured to calculate and store management information including a processing efficiency in unit time, a processing efficiency of each of a plurality of days, a processing efficiency for each operator ID, a total number of processed sheets, and a total operation time in accordance with inspection information provided from the inspection device, and to cause the display device to display the management information.

12. The sheet processing apparatus according to claim 1, wherein the paper sheets stacked on the feeding unit comprise a batch card having a color and a bar code representing information about a batch, the batch card being stacked at a last stage of a predetermined batch of paper sheets, and which further comprises a color sensor configured to detect a color of the batch card, a bar code reader configured to read the bar code of the batch card, and an accumulation unit configured to collect the batch card having passed through the inspection unit.

13. A sheet processing apparatus, comprising:

a feeding unit having a support surface inclined with respect to a vertical direction and a stacking surface substantially perpendicular to the support surface, a plurality of paper sheets being stacked on the stacking surface in such a manner that the paper sheets are inclined along the support surface;

a pick up mechanism configured to pick up the paper sheets from a side of the stacking surface of the feeding unit;

a conveying path configured to convey the picked up paper sheets;

an inspection device configured to inspect the conveyed paper sheet;

an accumulation unit configured to accumulate the inspected paper sheets; and a foreign matter collection unit provided below a lowermost portion of the conveying path, wherein the conveying path includes a discharge opening for discharging a foreign matter taken out of the conveying path to the foreign matter collection unit.

* * * * *